US011073770B2

(12) United States Patent
Zhu et al.

(10) Patent No.: US 11,073,770 B2
(45) Date of Patent: Jul. 27, 2021

(54) ELECTROPHOTOGRAPHIC PHOTORECEPTOR, PRODUCTION METHOD THEREOF, AND ELECTROPHOTOGRAPHIC APPARATUS

(71) Applicant: FUJI ELECTRIC CO., LTD., Kawasaki (JP)

(72) Inventors: Fengqiang Zhu, Matsumoto (JP); Tomoki Hasegawa, Hino (JP); Shinjiro Suzuki, Matsumoto (JP); Masaru Takeuchi, Matsumoto (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/775,854

(22) Filed: Jan. 29, 2020

(65) Prior Publication Data

US 2020/0301294 A1 Sep. 24, 2020

(30) Foreign Application Priority Data

Mar. 18, 2019 (JP) ..... JP2019-050275

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/056* (2013.01); *G03G 5/0525* (2013.01);
(Continued)

(58) Field of Classification Search
CPC .... G03G 5/047; G03G 5/0589; G03G 5/0592; G03G 5/087
(Continued)

(56) References Cited

U.S. PATENT DOCUMENTS

2015/0079510 A1 3/2015 Zhu et al.
2015/0253682 A1 9/2015 Azuma et al.
2018/0224760 A1 8/2018 Suzuki et al.

FOREIGN PATENT DOCUMENTS

JP S61-62040 A 3/1986
JP H01-205171 A 8/1989
(Continued)

OTHER PUBLICATIONS

Japan Patent Office, Office Action, Patent Application No. JP2019-050275, dated May 14, 2019.

*Primary Examiner* — Mark A Chapman
(74) *Attorney, Agent, or Firm* — Rabin & Berdo, P.C.

(57) ABSTRACT

An electrophotographic photoreceptor includes an electroconductive substrate; and a photosensitive layer that is formed on the electroconductive substrate and that contains an inorganic oxide and a lubricant resin which contains a polycarbonate resin having a siloxane structure therein or a polyarylate resin having a siloxane structure therein. When light having a wavelength of 780 nm is irradiated onto a slurry containing 20% by mass of the inorganic oxide in a predetermined solvent to provide an inorganic oxide slurry, the inorganic oxide slurry has a light transmittance that is 80% or more. The photosensitive layer may be a negatively-charged laminate-type photosensitive layer, a monolayer type photosensitive layer, or a positively-charged laminate-type photosensitive layer. The electrophotographic photoreceptor is less worn upon long-term use, allows no filming, and can realize stable images. A method for producing the electrophotographic photoreceptor and an electrophotographic apparatus including the electrophotographic photoreceptor are disclosed.

13 Claims, 2 Drawing Sheets

(51) Int. Cl.
*G03G 5/05* (2006.01)
*G03G 5/087* (2006.01)
*G03G 15/00* (2006.01)

(52) U.S. Cl.
CPC ..... *G03G 5/0564* (2013.01); *G03G 5/0589* (2013.01); *G03G 5/0592* (2013.01); *G03G 5/087* (2013.01); *G03G 15/75* (2013.01)

(58) Field of Classification Search
USPC ..... 430/59.1
See application file for complete search history.

(56) References Cited

FOREIGN PATENT DOCUMENTS

| | | | |
|---|---|---|---|
| JP | H03-273256 | A | 12/1991 |
| JP | H04-368953 | A | 12/1992 |
| JP | H07-333881 | A | 12/1995 |
| JP | H11-65134 | A | 3/1999 |
| JP | H11-65136 | A | 3/1999 |
| JP | 2002-091021 | A | 3/2002 |
| JP | 2002-229239 | A | 8/2002 |
| JP | 2008-176054 | A | 7/2008 |
| JP | 2012-042628 | A | 3/2012 |
| JP | 2013-195439 | A | 9/2013 |
| JP | 2015-169858 | A | 9/2015 |
| WO | 2013/128575 | A1 | 9/2013 |
| WO | 2017/109926 | A1 | 6/2017 |
| WO | 2017/110300 | A1 | 6/2017 |

ELECTROPHOTOGRAPHIC PHOTORECEPTOR, PRODUCTION METHOD THEREOF, AND ELECTROPHOTOGRAPHIC APPARATUS

CROSS-REFERENCE TO RELATED APPLICATION(S)

This non-provisional application for a U.S. patent claims the benefit of priority of JP 2019-050275 filed Mar. 18, 2019, the entire content of which is hereby incorporated by reference.

BACKGROUND OF THE INVENTION

1. Field of the Invention

The present invention relates to an electrophotographic photoreceptor (hereinafter, also referred to as a "photoreceptor"), a production method thereof, and an electrophotographic apparatus. Specifically, the present invention relates to an electrophotographic photoreceptor which is mainly composed of a photosensitive layer including an electroconductive substrate and an organic material, and is used for an electrophotographic printer, a copying machine, a fax machine, etc., a production method thereof, and an electrophotographic apparatus.

2. Background of the Related Art

An electrophotographic photoreceptor has a basic structure in which a photosensitive layer having a photoconductive function is provided on an electroconductive substrate. In recent years, organic electrophotographic photoreceptors using organic compounds as functional components responsible for charge generation and transport have been actively researched and developed because of advantages such as material diversity, high productivity, and safety, and application thereof to copying machines and printers is ongoing.

Generally, a photoreceptor is required to have a function of holding surface charge in the dark, a function of generating charge through reception of light, and a function of transporting the generated charge. Photosensitive layers play these roles. The photoreceptor is classified into, on the basis of the form of photosensitive layers, namely, a monolayer type photoreceptor and a laminate type (function separation type) photoreceptor. The monolayer type photoreceptor includes a monolayer photosensitive layer having both a charge generation function and a charge transport function. The laminate type photoreceptor includes a photosensitive layer in which a charge generation layer and a charge transport layer are laminated. The charge generation layer is mainly responsible for a function of generating charge upon light reception. The charge transport layer is responsible for a function of holding surface charge in the dark and a function of transporting the charge generated in the charge generation layer upon light reception.

The photosensitive layer is generally formed by applying a coating solution prepared by dissolving or dispersing a charge generating material and a charge transport material, and a resin binder in an organic solvent onto an electroconductive substrate. In these organic electrophotographic photoreceptors, particularly in the outermost layers, the use of a polycarbonate as a resin binder, which is highly resistant to friction generated between the layer and paper or a blade for removing a toner, is excellent in flexibility, and has good exposure light transmittance, is often seen.

Meanwhile, the mainstream of recent electrophotographic apparatuses is namely a digital machine, which involves using monochromatic light such as argon, helium-neon, semiconductor laser, light-emitting diode or the like as an exposure light source, digitizing information including images and letters, etc., to convert the information into light signals, photo-irradiating the light signals onto a charged photoreceptor to form an electrostatic latent image on the photoreceptor surface, and then visualizing the image using a toner.

Examples of a method for charging a photoreceptor include a noncontact charging system wherein charging members such as scorotron and a photoreceptor are not in contact with each other, and a contact charging system wherein charging members such as a semiconductive rubber roller and a brush are in contact with the photoreceptor. The contact charging system has advantages of less ozone generation and low applied voltage required, compared with the noncontact charging system, since corona discharge takes place in the close vicinity of the photoreceptor. Therefore, the contact charging system is now the mainstay among particularly medium size to small size apparatuses, because it can realize more compact and low cost electrophotographic apparatuses with low environmental pollution.

As measures for cleaning the photoreceptor surface, scraping off using a blade and a simultaneous developing and cleaning process, etc., are mainly employed. Cleaning with a blade involves scraping off an untransferred residual toner on the surface of an organic photoreceptor with the use of a blade, and then recovering the scraped-off toner in a waste toner box, or, returning the toner into a developing device again. Such a scraping cleaner using a blade needs a recovery box for the recovered toner or a space for recycling, so that the full of the toner recovery box must be monitored. Furthermore, when paper powder and external additives remain on the blade, scratches are made on the surface of an organic photoreceptor and can shorten the life of the photoreceptor. Accordingly, a toner may be recovered in a developing process, and a process of suctioning magnetically or electrically such residual toner adhering onto the photoreceptor surface may be provided immediately before a developing roller.

Further, when a blade for cleaning is used, in order to improve cleaning performance, the rubber hardness and the contact pressure of the blade should be increased. Therefore, the photoreceptor is increasingly worn, resulting in potential variation, sensitivity variation, and image abnormality, and, in the case of a color machine, resulting in failures in color balance and reproducibility.

Meanwhile, when a cleaning-less mechanism that involves using a contact charging mechanism, and developing and cleaning with a developing device is used, a toner with a varied charging amount is generated in a contact charging mechanism portion. Further, if a reverse-polarity toner, which may be mixed in an extremely small amount, is present, there is a problem that such toner cannot be sufficiently removed from the photoreceptor surface, and the charging device is contaminated.

Further, ozone, nitrogen oxides and the like generated upon charging of a photoreceptor may contaminate the photoreceptor surface. This causes a problem of image deletion due to contaminants themselves, and a problem such that adhered substances lower the lubricity of the photoreceptor surface and facilitate adhesion of paper powder and toners, which causes blade noise, peeling, and formation of scratches on the surface.

Moreover, in order to enhance the toner transfer efficiency in a transfer step, it has been attempted to reduce a residual toner by performing the control to optimize transfer current according to a hygrothermal environment and the characteristics of paper. Accordingly, as organic photoreceptors appropriate for such process and contact charging system, organic photoreceptors with improved toner releasing property and organic photoreceptors that are less affected by transfer are required.

Methods for improving the outermost layer of a photoreceptor have been proposed to solve these problems. For example, Patent Documents 1 and 2 propose methods that involve adding a filler to a photosensitive surface layer in order to improve the durability of the photoreceptor surface. However, uniform dispersion of a filler is difficult by such a method that involves dispersing a filler in a film. Further, the presence of filler aggregates, decreased film transmittance and exposure light scattered by a filler result in non-uniform charge transport and charge generation, and thus image characteristics may deteriorate. Further, there is a method that involves adding a dispersion material in order to improve filler dispersibility, but in this case, the dispersion material itself adversely affects photoreceptor characteristics, making it difficult to sufficiently achieve both the photoreceptor characteristics and filler dispersibility. Furthermore, while the addition of a filler improves wear resistance, filming takes place easily on the photoreceptor surface, and handling of image failures is also not taken into consideration.

Further, Patent Documents 3, 4, 5 and 6 propose that a photosensitive layer contains filler particles in order to improve wear resistance, however, photoreceptor characteristics affected by particle aggregation upon preparation of a photosensitive layer coating solution, a production method of particles, effects on impurity control and surface treatment are not sufficiently verified.

Further, Patent Document 7 proposes that in order to obtain a photoreceptor causing less wears upon long-term use and being capable of realizing stable images, a photosensitive layer is formed using an inorganic oxide satisfying predetermined conditions, however, a problem of filming on the photoreceptor surface is not examined.

Meanwhile, for the purpose of improving the protection of a photosensitive layer, mechanical strength, and surface lubricity etc., a method that involves forming a surface protective layer on a photosensitive layer is proposed. However, these methods that involve forming a surface protective layer is problematic in that film formation on a charge transport layer is difficult, and achieving both charge transport performance and charge retention function sufficiently is difficult.

RELATED ART DOCUMENTS—PATENT DOCUMENTS

[Patent Document 1] JP H01-205171A;
[Patent Document 2] JP H07-333881A;
[Patent Document 3] JP2008-176054A;
[Patent Document 4] JP2002-091021A;
[Patent Document 5] JP2002-229239A;
[Patent Document 6] JP2015-169858A; and
[Patent Document 7] WO 2017/110300.

As described above, various techniques have been conventionally proposed for improving the outermost layer of a photoreceptor. However, the techniques disclosed in the patent documents cannot achieve both low wear amount and stable images upon long-term use and are also insufficient for maintaining good electric characteristics.

Accordingly, an object of the present invention is to provide an electrophotographic photoreceptor capable of reducing a wear amount on the photoreceptor surface upon long-term use, causing no filming on the photoreceptor surface, and obtaining stable images, a production method thereof, and an electrophotographic apparatus.

SUMMARY OF THE INVENTION

In order to solve the above-mentioned problems, the present inventors have conducted intensive studies on the materials of the outermost layer of a photoreceptor, and thus provide a photoreceptor having excellent film wear resistance, few image defects, and stable image quality when repeatedly used. Specifically, the present inventors have discovered that a satisfactory electrophotographic photoreceptor can be obtained by applying the following constitution, and thus have completed the present invention.

Specifically, an electrophotographic photoreceptor of a first aspect of the present invention includes: an electroconductive substrate; and a negatively charged laminate type photosensitive layer composed of a charge generation layer and a charge transport layer formed sequentially on the electroconductive substrate, wherein the charge transport layer contains an inorganic oxide and a lubricant resin, and a luminous transmittance is 40% or more, when light having a wavelength of 780 nm is irradiated to a 20% by mass inorganic oxide slurry obtained by dispersing 20% by mass of the inorganic oxide in a solvent.

Further, an electrophotographic photoreceptor of a second aspect of the present invention includes: an electroconductive substrate; and a monolayer type photosensitive layer formed on the electroconductive substrate and containing an inorganic oxide and a lubricant resin, wherein a luminous transmittance is 40% or more, when light having a wavelength of 780 nm is irradiated to a 20% by mass inorganic oxide slurry obtained by dispersing 20% by mass of the inorganic oxide in a solvent.

Further, an electrophotographic photoreceptor of a third aspect of the present invention includes: an electroconductive substrate; and a positively charged laminate type photosensitive layer composed of a charge transport layer and a charge generation layer formed sequentially on the electroconductive substrate, wherein the charge generation layer contains an inorganic oxide and a lubricant resin, and a luminous transmittance is 40% or more, when light having a wavelength of 780 nm is irradiated to a 20% by mass inorganic oxide slurry obtained by dispersing 20% by mass of the inorganic oxide in a solvent.

In the present invention, a photosensitive layer contains an inorganic oxide, so as to improve the mechanical strength of the photosensitive layer. Moreover, the present inventors have discovered that a high quality photoreceptor can be provided by the use of the inorganic oxide exhibiting extremely high light transmittance when dispersed in a solvent at a high concentration. In this case, the viscosity of the 20% by mass inorganic oxide slurry is preferably 50 mPa·s or less. Further, it is only required that the primary particle diameter of the inorganic oxide maintains a high transmittance when dispersed in a solvent, and preferably ranges from 1 to 500 nm.

As the lubricant resin, a polycarbonate resin containing a siloxane structure is preferably contained and a polyarylate resin containing a siloxane structure is also preferably contained. Further, the above photosensitive layer can be used as an outermost layer.

Further, the inorganic oxide preferably contains silica as a main component, more preferably contains silica as a main component and an aluminum element in an amount of 1 ppm to 1000 ppm. Furthermore, the inorganic oxide is preferably surface-treated with a silane coupling agent. As the silane coupling agent, suitably, a silane coupling agent having a structure represented by the following general formula (1) can be used:

$$(R_1)_n—Si—(OR_2)_{4-n} \quad (1)$$

(In the formula, Si represents a silicon atom, $R_1$ represents an organic group in a form where carbon is directly bonded to the silicon atom, $R_2$ represents an organic group, and n represents an integer of 0 to 3).

Further, a method for producing an electrophotographic photoreceptor of a fourth aspect of the present invention is a method for producing the above electrophotographic photoreceptor by forming the photosensitive layer containing an inorganic oxide and a lubricant resin using a photosensitive layer coating solution, including: a step of preparing an inorganic oxide slurry for obtaining an inorganic oxide slurry by primary dispersing the inorganic oxide in a solvent for the photosensitive layer coating solution; a step of preparing a solution for forming a photosensitive layer for obtaining a solution for forming a photosensitive layer by dissolving a charge transport material and a lubricant resin in the solvent for the photosensitive layer coating solution; and a step of preparing a photosensitive layer coating solution for obtaining the photosensitive layer coating solution by mixing the thus obtained inorganic oxide slurry and the solution for forming a photosensitive layer. The method further includes a step for coating the coating solution onto the electroconductive substrate to provide the photosensitive layer.

Further, an electrophotographic apparatus of a fifth embodiment of the present invention includes the electrophotographic photoreceptor.

According to the present invention, the use of a photosensitive layer having the above conditions makes it possible to obtain an electrophotographic photoreceptor capable of reducing the wear amount of the photoreceptor surface upon long-term use, causing no filming on the photoreceptor surface, and obtaining stable images. This is because of the following reasons.

In the present invention, the photosensitive layer contains an inorganic oxide, so as to improve the mechanical strength of the photosensitive layer. However, conventional techniques are disadvantageous in that when the inorganic oxide alone is dispersed in a solvent, aggregated portions are generated, and when dispersion is then performed upon mixing with a charge transport material and a resin component, sufficient dispersion cannot be performed because of increased viscosity due to the addition of the resin component, resulting in a photoreceptor with minute defects on the image. On the other hand, in the present invention, a very high luminous transmittance is exhibited when the inorganic oxide is dispersed at a high concentration with respect to the solvent, indicating the uniform dispersion of the inorganic oxide and the maintenance of the solvation state similarly to that of primary particles. Specifically, in the present invention, even if the inorganic oxide is dispersed in a solvent in a high concentration state, the viscosity of the slurry (dispersion liquid) is low, and as a result, facilitating the mixing with the coating solution in which the constituents of the other photosensitive layer are dissolved. Accordingly, the aggregability at the time of mixing is also reduced, so that a higher-quality photoreceptor can be provided.

Meanwhile, only the inorganic oxide contained therein can reduce the wear amount of the photoreceptor surface, but leads to an increase in frictional force between a cleaning blade and the photoreceptor surface. Particularly when the inorganic oxide having a particle diameter of 200 nm to 500 nm is contained, the temperature of the photoreceptor surface tends to increase, a silica component that is an external additive contained in a toner becomes softer because of the increased temperature of the photoreceptor surface, tends to adhere to the inorganic oxide, and cannot be cleanly removed easily by a cleaning blade, and thus filming takes place easily on the photoreceptor surface. In the present invention, through the use of a lubricant resin together with the inorganic oxide, frictional force between the cleaning blade and the photoreceptor surface is significantly reduced, the temperature rise of the photoreceptor surface is suppressed, and cleaning performance is improved, so that the problem of filming can also be solved. That both wear resistance and filming resistance can be achieved with the combination of such a specific inorganic oxide and a lubricant resin is the finding obtained for the first time by the studies conducted by the present inventors.

DETAILED DESCRIPTION OF THE INVENTION

Hereinafter, embodiments of the present invention will be described in detail with reference to the drawings. The present invention is not limited by the following description.

Figure 1A:
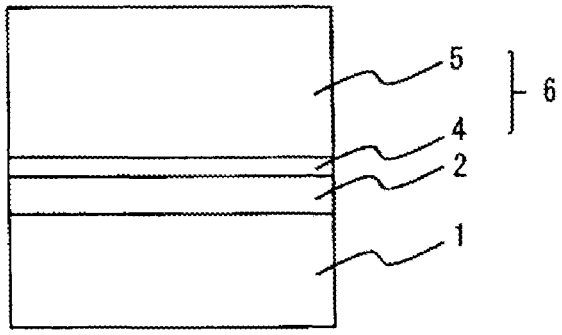
FIG. 1A is a schematic cross-sectional view illustrating a negatively charged laminate type electrophotographic photoreceptor according to the present invention.
Figure 1B:
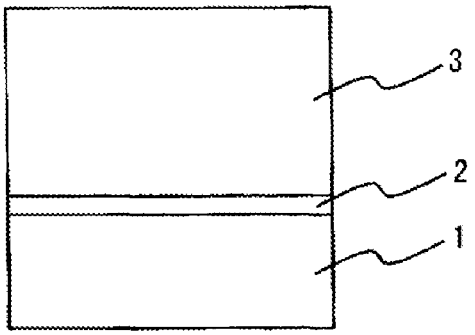
FIG. 1B is a schematic cross-sectional view illustrating a positively charged monolayer type electrophotographic photoreceptor according to the present invention.
Figure 1C:
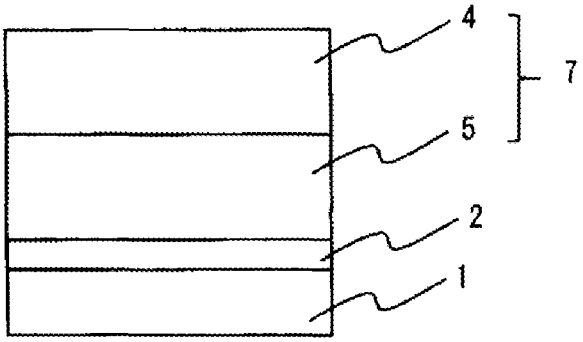
FIG. 1C is a schematic cross-sectional view illustrating a positively charged laminate type electrophotographic photoreceptor according to the present invention.

As described above, electrophotographic photoreceptors are broadly divided into so-called negatively charged laminate type photoreceptors and positively charged laminate type photoreceptors as laminate type (functional separation type) photoreceptors, and monolayer type photoreceptors mainly used in positively charged types. FIG. 1A to FIG. 1C are schematic cross-sectional views illustrating electrophotographic photoreceptors according to embodiments of the present invention. FIG. 1A illustrates a negatively charged laminate type electrophotographic photoreceptor, FIG. 1B illustrates a positively charged monolayer type electrophotographic photoreceptor, and FIG. 1C illustrates a positively charged laminate type electrophotographic photoreceptor.

As shown in the figures, in the negatively charged laminate type photoreceptor, an undercoat layer 2 and a photosensitive layer 6 having a charge generation layer 4 with a charge generation function and a charge transport layer 5 with a charge transport function are laminated sequentially on an electroconductive substrate 1. On the other hand, in the positively charged monolayer type photoreceptor, an undercoat layer 2 and a monolayer type photosensitive layer 3 with both charge generation and charge transport functions are laminated sequentially on an electroconductive substrate 1. Further, in the positively charged laminate type photoreceptor, an undercoat layer 2 and a photosensitive layer 7 having a charge transport layer 5 with a charge transport function and a charge generation layer 4 with both charge generation and charge transport functions are laminated sequentially on an electroconductive substrate 1. Note that in any type of the photoreceptors, the undercoat layer 2 may be provided as necessary. Further, the "photosensitive layer" of the present invention includes both the laminate type photosensitive layer in which the charge generation layer and the charge transport layer are laminated and the monolayer type photosensitive layer.

The photoreceptor of an embodiment of the present invention has at least a photosensitive layer on an electroconductive substrate, wherein the photosensitive layer contains an inorganic oxide and a lubricant resin, and the inorganic oxide to be used herein has a luminous transmittance of 40% or more when light having a wavelength of 780 nm is irradiated to a 20% by mass inorganic oxide slurry in which 20% by mass of the inorganic oxide is dispersed in a solvent. The transmittance is preferably 80% or more.

When the photoreceptor of an embodiment of the present invention is a monolayer type, the monolayer type photosensitive layer is a photosensitive layer containing the inorganic oxide and the lubricant resin. Further, when the photoreceptor of an embodiment of the present invention is a negatively charged laminate type having a negatively charged laminate type photosensitive layer composed of a charge generation layer and a charge transport layer laminated sequentially on an electroconductive substrate, the charge transport layer is the photosensitive layer containing the inorganic oxide and the lubricant resin. Further, the photoreceptor of an embodiment of the present invention is a positively charged laminate type having a positively charged laminate type photosensitive layer composed of a charge transport layer and a charge generation layer laminated sequentially on an electroconductive substrate, the charge generation layer is the photosensitive layer containing the inorganic oxide and the lubricant resin. Particularly when the photosensitive layer containing the inorganic oxide and the lubricant resin is an outermost layer, this is preferred since an effect of improving wear resistance can be successfully obtained.

The inorganic oxide may be any inorganic oxide as long as the transmittance falls within the above range when dispersed in a solvent. Examples thereof include, in addition to those containing silica as a main component, alumina, zirconia, titanium oxide, tin oxide and zinc oxide.

Among these, an inorganic oxide containing silica as a main component is preferable as the inorganic oxide. As a method for producing silica particles having a particle diameter of several nanometers to several tens of nanometers as silica, a production method using water glass as a raw material, which is referred to as a wet method, or a method for reacting chlorosilane or the like in a gas phase, which is referred to as a dry method, and a method using an alkoxide as a silica precursor as a raw material are known.

Here, if a large amount of different metals is present as impurities during the surface treatment of silica, defects will occur due to a metal differing from the normal oxide site, the surface charge distribution will fluctuate, and the aggregation of oxide particles will be improved with the site as an origin. As a result, aggregates are increased in the coating solution and the photosensitive layer. Hence, the purity of the silica is preferably high. Therefore, the content of a metal other than the metal element(s) constituting the inorganic oxide is preferably controlled to 1000 ppm or less of each metal element.

On the other hand, in order to sufficiently react the surface treatment agent and improve the activity of the silica surface, it is suitable to add in advance a very small amount of another type of metal. The surface treatment agent reacts with the hydroxyl group present on the silica surface, but if the silica contains a trace amount of other metal elements, reactivity of silanol group (hydroxyl group) adjacent to the other metal elements existing on the silica surface is improved due to the influence of the electronegativity difference between the metals. Since this hydroxyl group is highly reactive with the surface treatment agent, it reacts more strongly with the surface treatment agent than other hydroxyl groups, and if it remains, it will cause aggregation. After the reaction of these surface treatment agents, the surface treatment agent reacts with other hydroxyl groups, so that the aggregability between silicas is greatly improved due to the effect of the surface treatment agent and the effect of reducing the surface charge bias due to the different types of metal on the surface. Hence, when the inorganic oxide contains a trace amount of other metals, the surface treatment agent has better reactivity, and as a result, the dispersibility resulting from the surface treatment is improved, and thus this is preferable.

As for silica, it is suitable to add in advance an aluminum element at a concentration up to 1000 ppm or less for surface treatment. The amount of the aluminum element in silica can be adjusted using methods described in JP2004-143028A, JP2013-224225A, JP2015-117138A, etc. The preparation method is not particularly limited as long as the amount thereof can be controlled within the above desired range. Specific examples of a method for more suitably controlling the amount of an aluminum element on the silica surface include the following methods: a method that involves, when silica fine particles are produced, controlling the amount of aluminum on the silica surface by, for example, adding aluminum alkoxide as an aluminum source after growing the silica particles in a shape smaller than the target silica particle diameter; a method that involves placing silica fine particles in a solution containing aluminum chloride, coating the surface of the silica fine particles with an aluminum chloride solution, and drying and firing the resultant; and a method that involves reacting a mixed gas of an aluminum halide compound and a silicon halide compound.

In addition, the structure of silica is known to have a net-like bond structure in which a plurality of silicon atoms and oxygen atoms are connected in a ring, and when the structure contains an aluminum element, the number of atoms constituting the silica ring structure is higher than that of normal silica because of the effect of mixing with aluminum. Due to this effect, the steric hindrance when the surface treatment agent reacts with the hydroxyl group on the silica surface containing an aluminum element is alleviated compared to the normal silica surface, and the reactivity of the surface treatment agent is improved, resulting in the surface-treated silica having improved dispersibility as compared with a case where the same surface treatment agent is reacted with normal silica.

Here, silica produced by the wet process is more suitable in order to control the amount of an aluminum element.

Further, the content of the aluminum element with respect to silica is suitably 1 ppm or more in view of the reactivity of the surface treatment agent.

The form of the inorganic oxide is not particularly limited, but in order to reduce the aggregability and obtain a uniform dispersion state, the sphericity of the inorganic oxide is preferably 0.8 or more, and more preferably 0.9 or more.

Further, the viscosity when the inorganic oxide is dispersed (primary dispersion) in a solvent is preferably 50 mPa·s or less as the viscosity of the 20% by mass inorganic oxide slurry when 20% by mass of the inorganic oxide is dispersed in the solvent from the viewpoint of suitable mixing, more preferably 10 mPa·s or less.

Furthermore, the primary particle diameter of the inorganic oxide is only required to maintain a high transmittance when dispersed in a solvent, and is preferably 1 to 500 nm, more preferably 5 to 400 nm, and still more preferably 10 to 300 nm. Note that the dispersed particles may be in the form of primary particles or may form several clusters as long as the transmittance satisfies the above range.

Further, the average distance between the inorganic oxide particles in the photosensitive layer is not particularly limited as long as the above transmittance is obtained. The resulting particle diameter being close to the primary particle diameter is preferable because the binding force of the film component is improved by the interaction between particles, leading to improvement in the abrasiveness of the film. Specifically, it is preferably 200 nm or less, and more preferably 70 nm or less.

Also, when an inorganic oxide is used in a charge transport layer of a photoreceptor that is expected to have high resolution, the influence of a rays etc., derived from a material added to the charge transport layer is preferably taken into consideration. For example, taking a semiconductor memory element as an example, the memory element retains the type of data to be stored depending on the presence or the absence of the accumulation of charge, but the size of the accumulated charge is reduced by miniaturization. The data type changes due to the charge level that is altered by the α-rays irradiated from the outside, and as a result, unexpected data changes occur. In addition, since the magnitude of the current flowing through the semiconductor element is also reduced, the current (noise) generated by the a rays is relatively larger than the magnitude of the signal, and malfunction is concerned. In the same manner as that of the phenomenon, it is more suitable to use a material with less α-ray generation as the film constituent material in consideration of the influence on the charge movement of the charge transport layer of the photoreceptor. Specifically, it is effective to reduce the concentration of uranium and that of thorium in the inorganic oxide, preferably the concentration of thorium is 30 ppb or less and that of uranium is 1 ppb or less. A production method that involves reducing the amount of uranium and that of thorium in the inorganic oxide is described in, for example, JP2013-224225A, but is not limited to this method as long as the concentrations of these elements can be reduced.

In order for the inorganic oxide to maintain the transmittance conditions according to the present invention, it is suitable to perform surface treatment for the surface of the inorganic oxide. As the surface treatment agent, a commercially available surface treatment agent may be used as long as the transmittance can be obtained. More preferably, a silane coupling agent is used. Examples of silane coupling agents include phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatopropyltrimethoxysilane, phenyl aminotrimethoxysilane, acrylic trimethoxysilane, p-styryltrimethoxysilane, 3-acryloxypropyltrimethoxysilane, 3-methacryloxypropyltrimethoxysilane, 3-isocyanatopropyltrimethoxysilane, 3-aminopropyltrimethoxysilane and N-phenyl-3-aminopropyltrimethoxysilane, and those containing at least one of these examples can be used. Further, the alkyl group of alkoxide is preferably a methyl group, but in addition, an ethyl group, a propyl group, and a butyl group are also preferable. The treatment amount of the surface treatment agent relative to the inorganic oxide is such that the amount of the surface treatment agent ranges from 0.01 to 10.0% by mass, preferably 0.05 to 5.0% by mass with respect to the mass of the inorganic oxide after treatment.

More specifically, examples of the silane coupling agent include compounds having a structure represented by general formula (1) below, but are not limited thereto, and also include compounds that undergo a condensation reaction with a reactive group such as a hydroxyl group on the surface of the inorganic oxide.

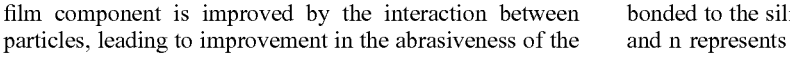

$$(R_1)_n—Si—(OR_2)_{4-n} \quad (1),$$

where, in the formula, Si represents a silicon atom, $R_1$ represents an organic group in a form where carbon directly bonded to the silicon atom, $R_2$ represents an organic group, and n represents an integer of 0 to 3.

In the organosilicon compound represented by general formula (1) above, examples of $R_1$ include alkyl groups such as methyl, ethyl, propyl, butyl, pentyl, hexyl, octyl, and dodecyl, and aryl groups such as phenyl, tolyl, naphthyl, and biphenyl, epoxy-containing groups such as γ-glycidoxypropyl and β-(3,4-epoxycyclohexyl) ethyl, (meth)acryloyl-containing groups such as γ-acryloxypropyl and γ-methacryloxypropyl, hydroxy-containing groups such as γ-hydroxypropryl and 2,3-dihydroxypropyloxypropyl, vinyl-containing groups such as vinyl and propenyl, mercapto-containing groups such as γ-mercaptopropyl, amino-containing groups such as p-aminophenyl, γ-aminopropyl, N-β (aminoethyl)-γ-aminopropyl and N-phenyl-3-aminopropyl, halogen-containing groups such as m-aminophenyl, o-aminophenyl, γ-chloropropyl, 1,1,1-trifluoropropyl, nonafluorohexyl, and perfluorooctylethyl, and other nitro and cyano-substituted alkyl groups. Further, examples of the hydrolyzable group of $OR_2$ include alkoxy groups such as methoxy and ethoxy, halogen groups, and acyloxy groups.

The silane coupling agent represented by general formula (1) above may be used independently or in combination of two or more types thereof. Moreover, when multiple types thereof are combined, two types of coupling agents can be reacted with an inorganic oxide simultaneously, or multiple types thereof can also be reacted in order.

In the silane coupling agent represented by general formula (1) above, when n is 2 or more, the plurality of $R_1$ may be the same or different. Similarly, when n is 2 or less, the plurality of $R_2$ may be the same or different. Further, when two or more types of the organosilicon compound represented by general formula (1) above are used, $R_1$ and $R_2$ may be the same or different in each coupling agent.

Examples of the compound wherein n is 0 include tetramethoxysilane, tetraacetoxysilane, tetraethoxysilane, tetraallyloxysilane, tetrapropoxysilane, tetraisopropoxysilane, tetrakis(2-methoxyethoxy)silane, tetrabutoxysilane, tetraphenoxysilane, tetrakis(2-ethylbutoxy)silane, and tetrakis(2-ethylhexyloxy)silane.

Examples of the compound wherein n is 1 include methyltrimethoxysilane, mercaptomethyltrimethoxysilane, trimethoxyvinylsilane, ethyltrimethoxysilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allylaminopropyltrimethoxysilane, propyltriethoxysilane, hexyltrimethoxysilane, 3-aminopropyltriethoxysilane, N-phenyl-3-aminopropyltrimethoxysilane, 3-methacryloxypropyltrimethoxysilane, bis(ethylmethylketoxime)methoxymethylsilane, pentyltriethoxysilane, octyltriethoxysilane, and dodecyltriethoxysilane.

Examples of the compound wherein n is 2 include dimethoxymethylsilane, dimethoxydimethylsilane, diethoxysilane, diethoxymethylsilane, dimethoxymethyl-3,3,3-trifluoropropylsilane, 3-chloropropyldimethoxymethylsilane, chloromethyldiethoxysilane, diethoxydimethylsilane, dimethoxy-3-mercaptopropylmethylsilane, diacetoxymethylvinylsilane, diethoxymethylvinylsilane, 3-aminopropyldiethoxymethylsilane, 3-(2-aminoethylaminopropyl) dimethoxymethylsilane, 3-methacryloxypropyldimethoxymethylsilane, 3-(3-cyanopropylthiopropyl)dimethoxymethylsilane, 3-(2-acetoxyethylthiopropyl) dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxypropylthio)propyldimethoxymethylsilane, dimethoxymethyl-3-piperidinopropylsilane, and diethoxymethyloctadecylsilane.

Examples of the compound wherein n is 3 include the following compounds; that is, methoxytrimethylsilane, ethoxytrimethylsilane, methoxydimethyl-3,3,3-trifluoropropylsilane, 3-chloropropylmethoxydimethylsilane, and methoxy-3-mercaptopropylmethylmethylsilane.

Further, the photosensitive layer coating solution according to the present invention may contain a trace amount of a hydrolysate of a silane coupling agent. Specifically, a compound having a structure represented by the following general formula (2) may be contained at 2% by mass or less:

$$Si(OH)_m(R_1)_n(OR_2)_{4-(n+m)} \quad (2),$$

where, in the formula, Si represents a silicon atom, $R_1$ represents an organic group in a form where carbon is directly bonded to the silicon atom, $R_2$ represents an organic group, m represents an integer of 1 to 4, n represents an integer of 0 to 3, and m+n is 4 or less.

When the inorganic oxide is surface-treated with a plurality of types of surface treatment agents, surface treatment may be performed in any order in the step of surface treatment. For example, when the inorganic oxide is surface-treated with a plurality of types of silane coupling agents, the silane coupling agent having the structure represented by general formula (1) above is preferably used first for surface treatment. Further, in the surface treatment step, silica may be simultaneously surface-treated with a silane coupling agent and organosilazane, or, silica may be surface-treated first with a silane coupling agent and then surface-treated with organosilazane. Furthermore, silica may be surface-treated first with organosilazane, then surface-treated with a silane coupling agent, and then surface-treated with organosilazane.

Here, the wavelength for measuring the transmittance of a 20% by mass inorganic oxide slurry (inorganic oxide slurry) is arbitrarily selected from the range from the visible range to the laser wavelength range used for exposure of the electrophotographic apparatus, and it can be confirmed by the transmittance at a wavelength of 780 nm used in the electrophotographic apparatus.

The solvent to be used for slurrying of the inorganic oxide is not particularly limited as long as the inorganic oxide satisfies the above transmittance, and a solvent for the photosensitive layer coating solution may be used. Preferred examples thereof include, but are not limited to, tetrahydrofuran (THF), 1,3-dioxolane, tetrahydropyran, methyl ethyl ketone, methyl isobutyl ketone, cyclohexanone, toluene, methylene chloride, 1,2-dichloroethane, chlorobenzene, ethylene glycol, ethylene glycol monomethyl ether, and 1,2-dimethoxyethane, and these examples can be used independently or mixed and then used. Preferably, tetrahydrofuran or a mixed solvent containing the same is used.

The inorganic oxide slurry can be obtained by any method, as long as the inorganic oxide and a solvent can be mixed by stirring for slurrying. Examples of a disperser used for dispersion upon slurrying can include a paint shaker, a ball mill, and a sand mill.

As a lubricant resin, for example, specifically, a polycarbonate resin containing a siloxane structure, a polyarylate resin containing a siloxane structure, or the like can be suitably used.

Examples of the polycarbonate resin containing a siloxane structure can include a polycarbonate resin having a repeating structure represented by the following general formula (3):

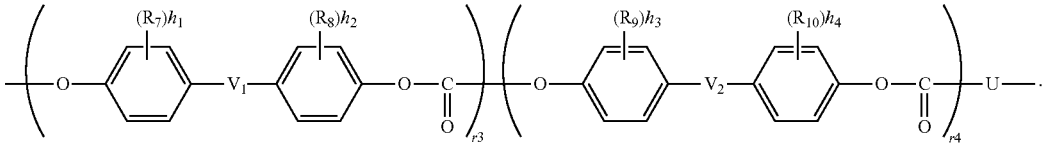

In general formula (3) above, $R_7$ to $R_{10}$ may be the same or different, and each represents a hydrogen atom, or a C1-C10 alkyl group or C1-C10 fluoroalkyl group, $h_1$, $h_2$, $h_3$ and $h_4$ are each an integer of 0 to 4, $V_1$ represents an aliphatic divalent group or a cycloaliphatic divalent group, $V_2$ represents a single bond, a C1-C12 linear, branched or cyclic alkylene group, —O—, —S—, —SO—, —$SO_2$—, or, —CO—, and U represents a structural unit represented by the following structural formula (4), (5) or (6):

(4)

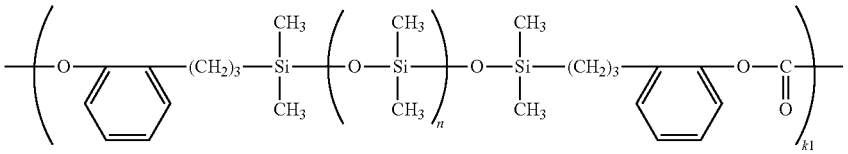

(5)

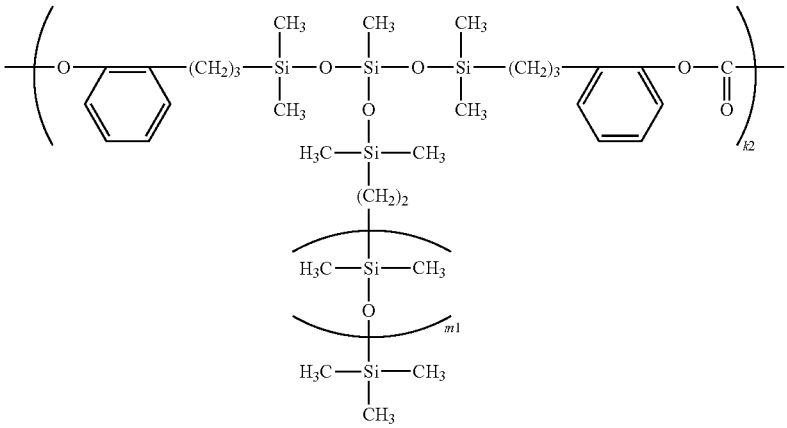

, and (6)

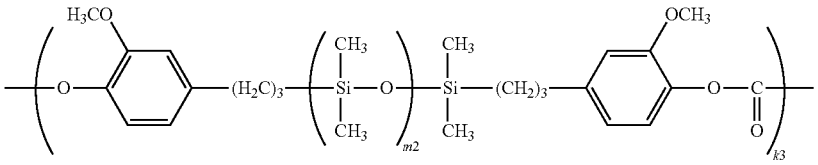

In structural formulae (4) to (6) above, n, m1 and m2 are each an integer of 1 or more and 400 or less, and preferably an integer of 8 or more and 250 or less.

Further, in general formula (3) above, r3 and r4 satisfy $0.2 \leq r4/(r3+r4) \leq 0.8$, and r3, r4, k1, k2, and k3 satisfy $0.001 \leq k1/(r3+r4+k1) \leq 0.005$, $0.001 \leq k2/(r3+r4+k2) \leq 0.005$, and $0.001 \leq k3/(r3+r4+k3) \leq 0.005$. A chain terminal group is a monovalent aromatic group or a monovalent fluorine-containing aliphatic group.

Examples of the polyarylate resin containing a siloxane structure can include a co-polymerized polyarylate resin having a structural unit represented by the following structural formula (7).

Structural formula (7)

($A_1$)

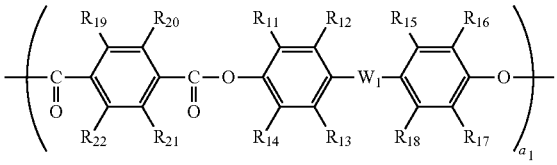

($A_2$)

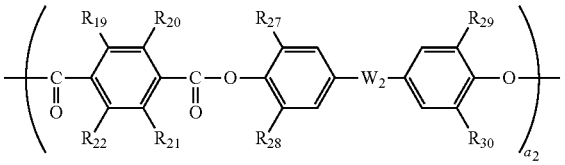

-continued (B1)

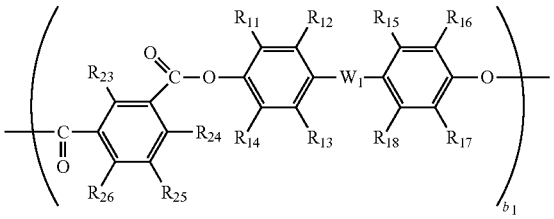

(B2)

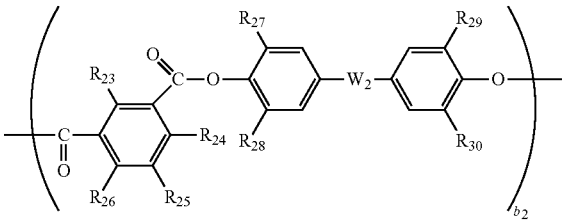

(C)

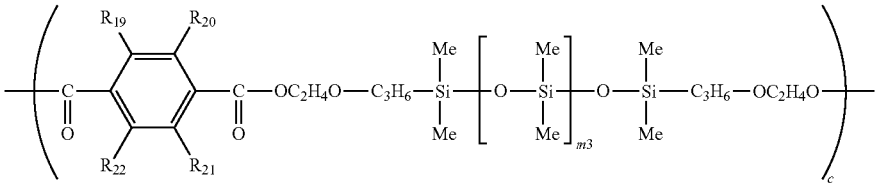

(D)

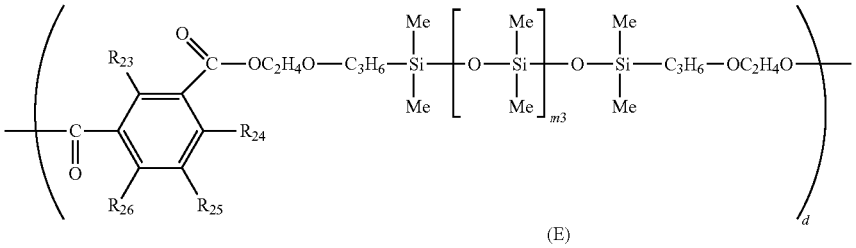

(E)

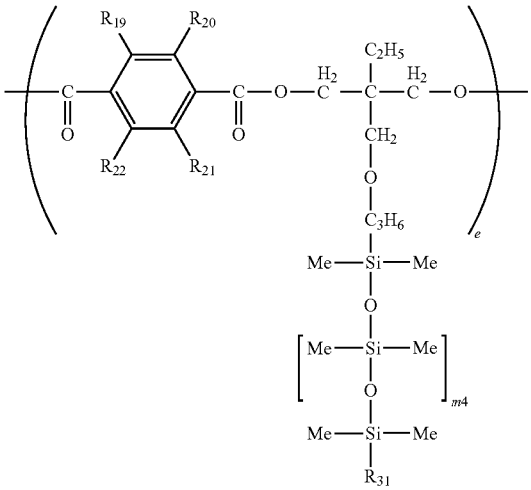

(F)

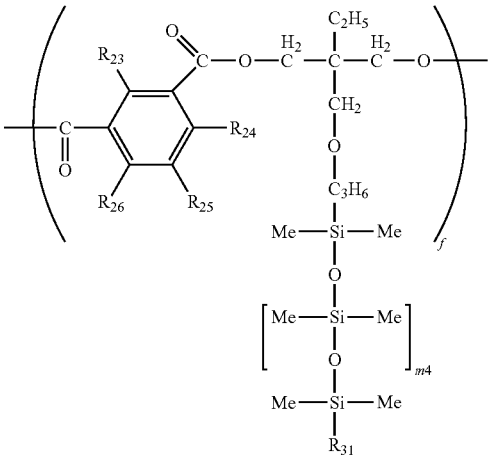

In structural formula (7) above, partial structural formulae ($A_1$), ($A_2$), ($B_1$), ($B_2$), (C), (D), (E) and (F) represent structural units constituting resins, $a_1$, $a_2$, $b_1$, $b_2$, c, d, e and f represent the mol % of structural units ($A_1$), ($A_2$), ($B_1$), ($B_2$), (C), (D), (E) and (F), respectively, the sum of $a_1+a_2+b_1+b_2+c+d+e+f$ is 100 mol %, and the sum of c+d+e+f is between 0.001 and 10 mol %. Further, $W_1$ and $W_2$ are different two types selected from the group consisting of a single bond, —O—, —S—, —SO—, —CO—, —$SO_2$—, —$CR_{41}R_{42}$— ($R_{41}$ and $R_{42}$ may be the same or different, and each represents a hydrogen atom, a C1-C12 alkyl group, an alkyl halide group, or, a C6-C12 substituted or unsubstituted aryl group), a C5-C12 substituted or unsubstituted cycloalkylidene group, a C2-C12 substituted or unsubstituted α,ω alkylene group, -9,9-fluorenylidene group, a C6-C12 substituted or unsubstituted arylene group, and, a divalent group containing a C6-C12 aryl group or an arylene group. $R_{11}$ to $R_{30}$ may be the same or different and each represents a hydrogen atom, a C1-C8 alkyl group, a fluorine atom, a chlorine atom, or a bromine atom. $R_{31}$ represents a hydrogen atom, a C1-C20 alkyl group, an aryl group that may have a substituent or a cycloalkyl group that may have a substituent, a fluorine atom, a chlorine atom, or a bromine atom. m3 and m4 each represents an integer of 1 or more.

In the above co-polymerized polyarylate resin, when the total amount ($a_1+a_2+b_1+b_2+c+d+e+f$) of the structural units represented by structural formula (7) above is designated as 100 mol %, the amount of siloxane components, (c+d+e+f), ranges from 0.001 to 10 mol %, and preferably 0.03 to 10 mol %. When the amount of siloxane components, (c+d+e+f), is lower than 0.001 mol %, sustainable sufficient friction coefficients may not be obtained. On the other hand, when the amount, (c+d+e+f), is higher than 10 mol %, sufficient film hardness cannot be obtained and furthermore, the resulting coating solution may not have sufficient compatibility with a solvent and functional materials.

Further, in structural formula (7) above, m3 and m4 are each an integer of 1 or more and 400 or less, and preferably an integer of 8 or more and 250 or less.

Further, to obtain the desired effects of the present invention, in structural formula (7) above, $W_2$ is preferably a single bond, —O— or —$CR_{41}R_{42}$— ($R_{41}$ and $R_{42}$ may be the same or different, and each represents a hydrogen atom, a methyl group or an ethyl group), and, $W_1$ is preferably —$CR_{41}R_{42}$— ($R_{41}$ and $R_{42}$ may be the same or different, and each represents a hydrogen atom, a methyl group or an ethyl group).

Furthermore, examples of siloxane structures in structural formula (7) above can include constituent monomers such as those represented by the following molecular formula (8) (manufactured by Chisso Corporation, reactive silicones, Silaplane FM4411 (weight-average molecular weight of 1000), FM4421 (weight-average molecular weight of 5000) and FM4425 (weight-average molecular weight of 15000)), and those represented by the following molecular formula (9) (manufactured by Chisso Corporation, reactive silicones, Silaplane FMDA11 (weight-average molecular weight of 1000), FMDA21 (weight-average molecular weight of 5000), and FMDA26 (weight-average molecular weight of 15000)).

Molecular formula (8)

| Structural Formula No. | Basic structure | Average molecular weight | Structure example |
|---|---|---|---|
| Formula (8)-1 | 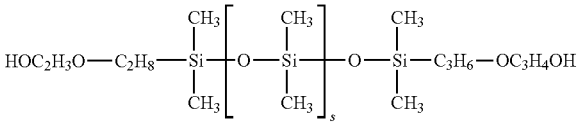 | 1000 | Manufactured by Chisso Corporation Silaplane FM-4411 |
| Formula (8)-2 | | 5000 | Manufactured by Chisso Corporation Silaplane FM-4421 |
| Formula (8)-3 | | 10000 | Manufactured by Chisso Corporation Silaplane FM-4425 |

Molecular formula (9)

| Structural Formula No. | Basic structure | Average molecular weight | Structure example |
|---|---|---|---|
| Formula (9)-1 | 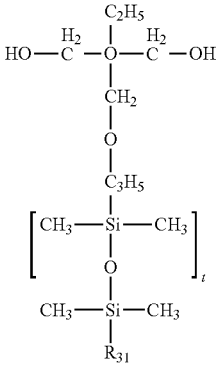 | 1000 | Manufactured by Chisso Corporation Silaplane FM-DA11 |
| Formula (9)-2 | | 5000 | Manufactured by Chisso Corporation Silaplane FM-DA21 |
| Formula (9)-3 | | 15000 | Manufactured by Chisso Corporation Silaplane FM-DA25 |

*In the formula, $R_{31}$ represents an n-butyl group.

Specific examples of structural formulae ($A_1$), ($A_2$), ($B_1$), ($B_2$), (C), (D), (E) and (F) representing the structural units of the polyarylate resin represented by chemical structural formula 7 above are as described below. Further, in Table 1 below, specific examples of the co-polymerized polyarylate resin having structural formulae ($A_1$), ($A_2$), ($B_1$), ($B_2$), (C), (D), (E) and (F) are listed. Note that co-polymerized polyarylate resins that can be used herein are not limited to those represented by the structures illustrated herein.

Specific examples of structural formula ($A_1$)

$A_{10}$

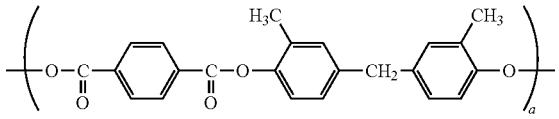

$A_{11}$

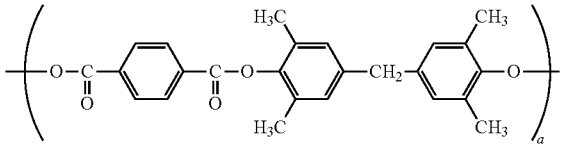

-continued
$A_{12}$
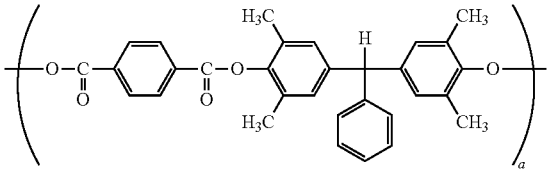
$A_{13}$
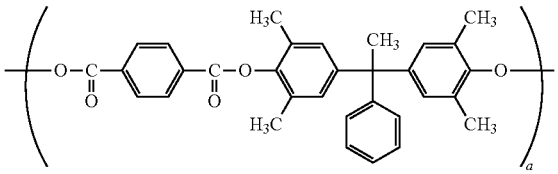
$A_{14}$
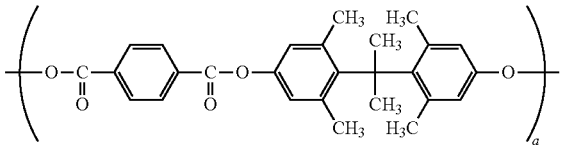
$A_{15}$
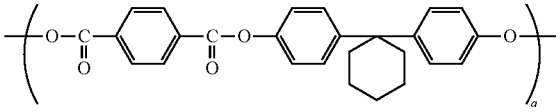
$A_{16}$
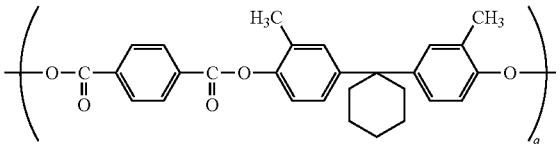
$A_{17}$
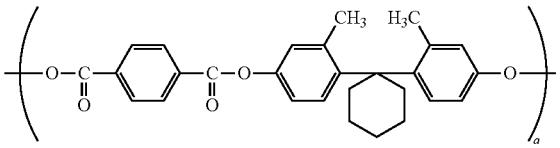
$A_{18}$
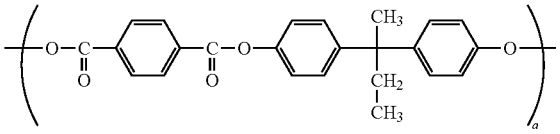
$A_{19}$
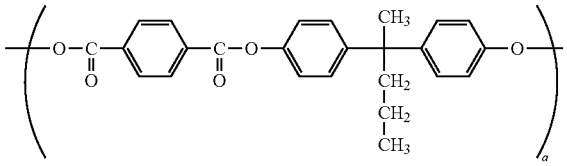
Specific examples of structural formula ($A_2$)
$A_{20}$
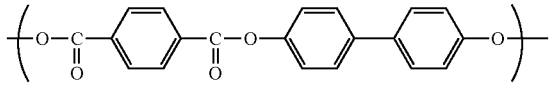
$A_{21}$
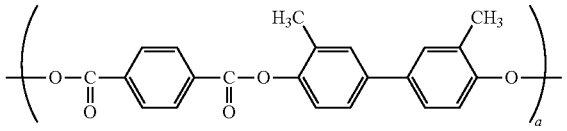
$A_{22}$
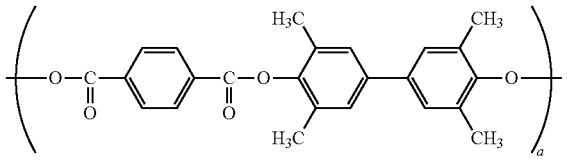
$A_{23}$
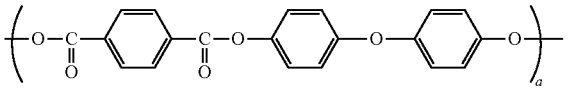
$A_{24}$
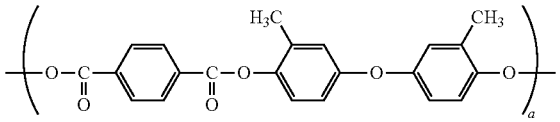
$A_{25}$
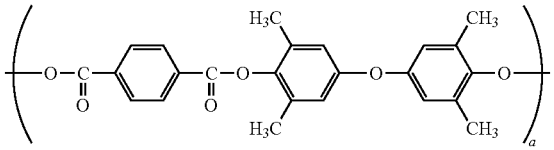
$A_{26}$
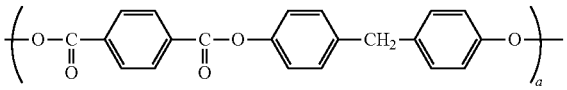
$A_{27}$
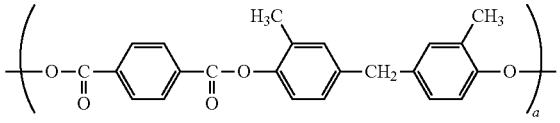
$A_{28}$
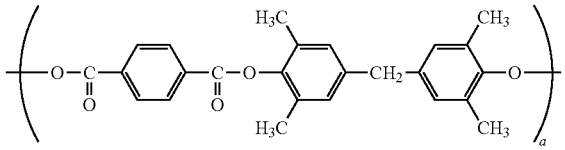
$A_{29}$
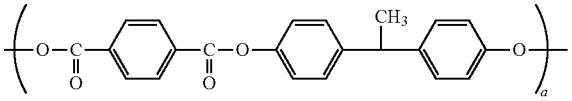

Specific examples of structural formula ($B_1$)
$B_{10}$
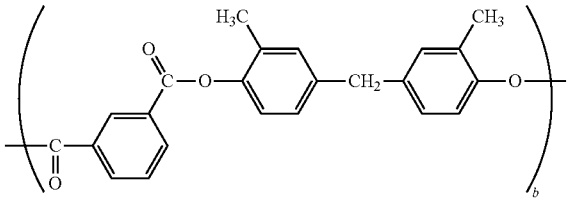
$B_{11}$
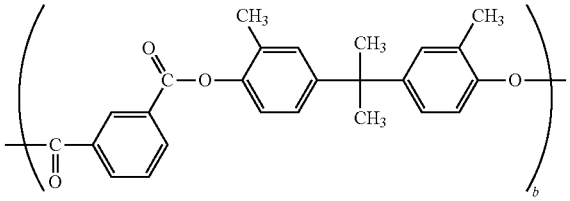
$B_{12}$
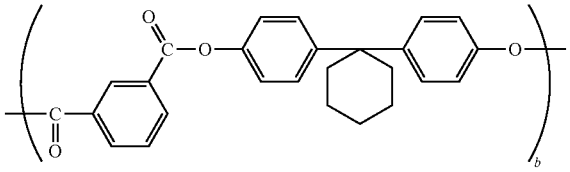
$B_{13}$
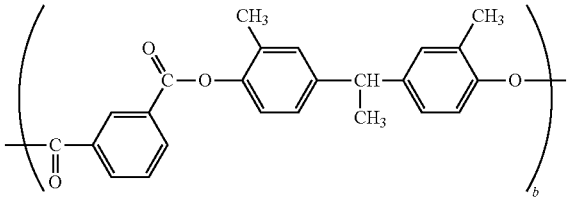
$B_{14}$
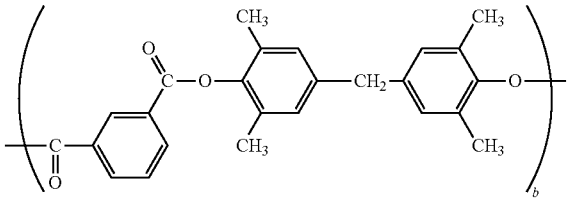
$B_{15}$
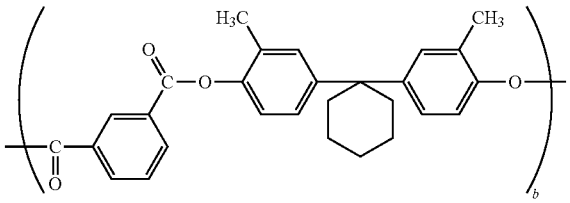
-continued
$B_{16}$
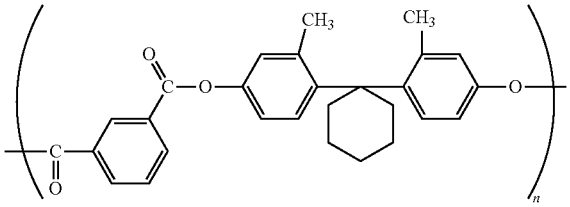
$B_{17}$
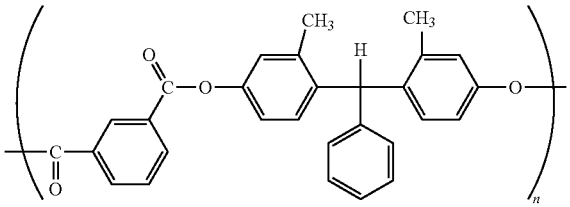
$B_{18}$
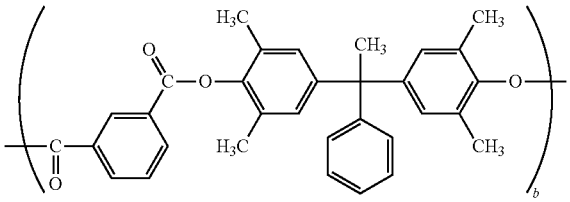
$B_{19}$
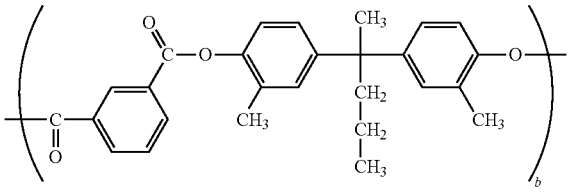
Specific examples of structural formula ($B_2$)
$B_{20}$
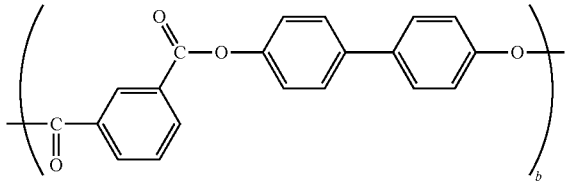
$B_{21}$
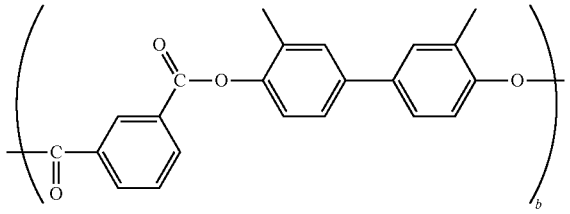

-continued
$B_{22}$
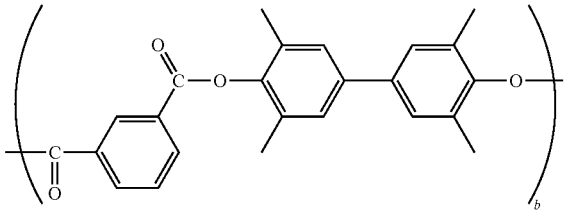
$B_{23}$
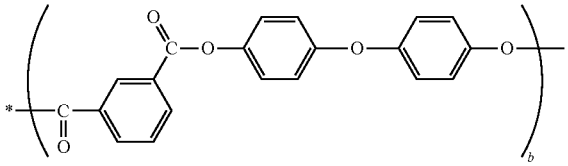
$B_{24}$
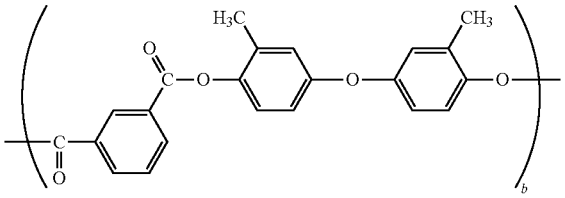
$B_{25}$
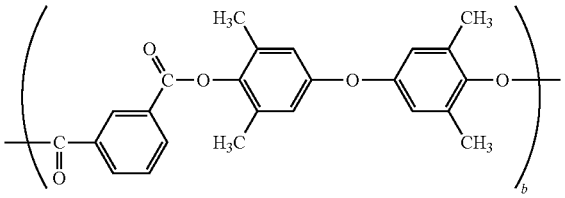
-continued
$B_{26}$
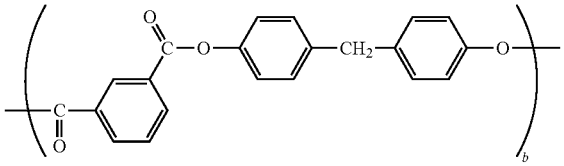
$B_{27}$
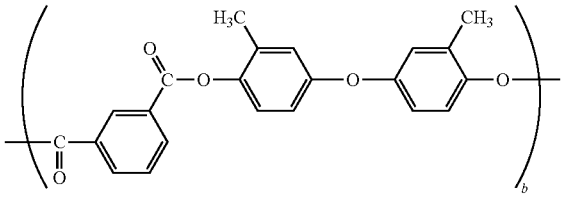
$B_{28}$
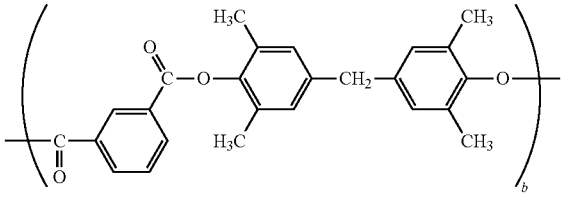
$B_{29}$
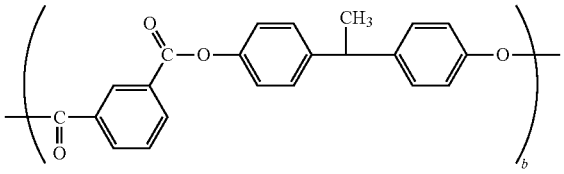
Specific examples of structural formula (C):
C1
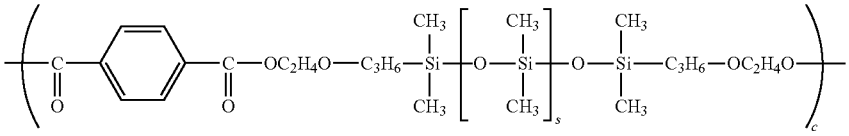
Specific examples of structural formula (D):
D1
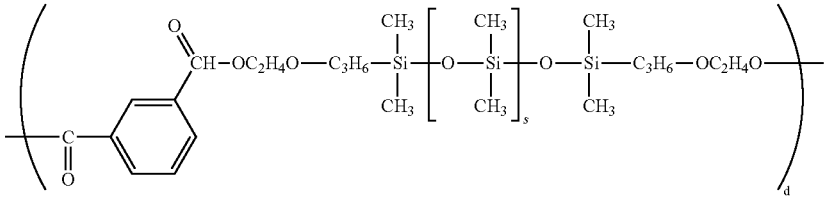

Specific examples of structural formula (E)

E1

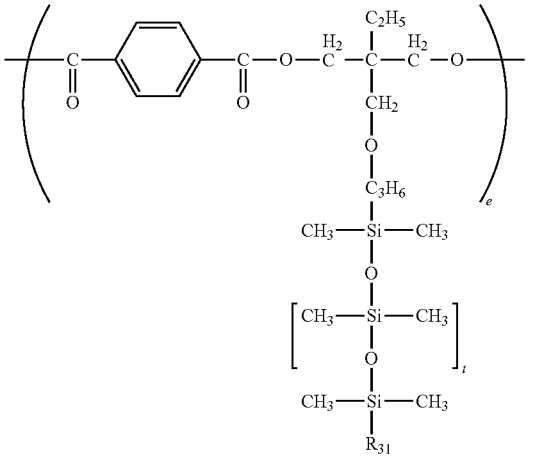

Specific examples of structural formula (F)

F1

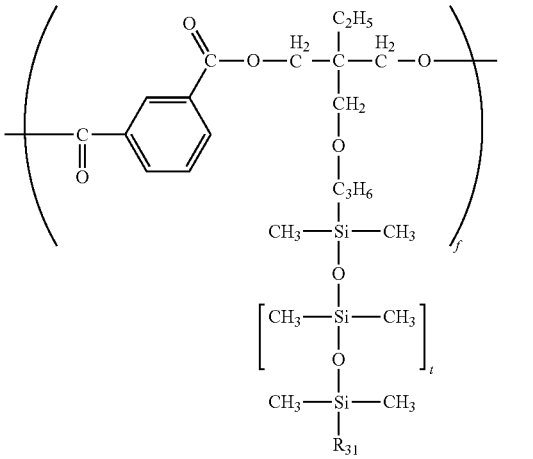

In the formula, $R_{31}$ represents an n-butyl group.

TABLE 1

| Structure | Constituent monomer type | | | | | | | |
|---|---|---|---|---|---|---|---|---|
| No. | A1 | A2 | B1 | B2 | C | D | E | F |
| I-1 | A10 | | | | | | | |
| I-2 | | | B10 | | | | | |
| I-3 | A10 | A20 | B10 | B20 | C1 | D1 | | |
| I-4 | A11 | A21 | B11 | B21 | C1 | D1 | | |
| I-5 | A12 | A22 | B12 | B22 | C1 | D1 | | |
| I-6 | A13 | A23 | B13 | B23 | C1 | D1 | | |
| I-7 | A14 | A24 | B14 | B24 | C1 | D1 | | |
| I-8 | A15 | A25 | B15 | B25 | C1 | D1 | | |
| I-9 | A16 | A26 | B16 | B26 | C1 | D1 | | |
| I-10 | A17 | A27 | B17 | B27 | C1 | D1 | | |
| I-11 | A18 | A28 | B18 | B28 | C1 | D1 | | |
| I-12 | A19 | A29 | B19 | B29 | C1 | D1 | | |
| I-13 | A10 | A20 | B10 | B20 | | | E1 | F1 |
| I-14 | A11 | A21 | B11 | B21 | | | E1 | F1 |
| I-15 | A12 | A22 | B12 | B22 | | | E1 | F1 |
| I-16 | A13 | A23 | B13 | B23 | | | E1 | F1 |

TABLE 1-continued

| Structure | Constituent monomer type | | | | | | | |
|---|---|---|---|---|---|---|---|---|
| No. | A1 | A2 | B1 | B2 | C | D | E | F |
| I-17 | A14 | A24 | B14 | B24 | | | E1 | F1 |
| I-18 | A15 | A25 | B15 | B25 | | | E1 | F1 |
| I-19 | A16 | A26 | B16 | B26 | | | E1 | F1 |
| I-20 | A17 | A27 | B17 | B27 | | | E1 | F1 |
| I-21 | A18 | A28 | B18 | B28 | | | E1 | F1 |
| I-22 | A19 | A29 | B19 | B29 | | | E1 | F1 |
| I-23 | A10 | A20 | B10 | B20 | C1 | D1 | E1 | F1 |
| I-24 | A11 | A21 | B11 | B21 | C1 | D1 | E1 | F1 |
| I-25 | A12 | A22 | B12 | B22 | C1 | D1 | E1 | F1 |
| I-26 | A13 | A23 | B13 | B23 | C1 | D1 | E1 | F1 |
| I-27 | A14 | A24 | B14 | B24 | C1 | D1 | E1 | F1 |
| I-28 | A15 | A25 | B15 | B25 | C1 | D1 | E1 | F1 |
| I-29 | A16 | A26 | B16 | B26 | C1 | D1 | E1 | F1 |
| I-30 | A17 | A27 | B17 | B27 | C1 | D1 | E1 | F1 |
| I-31 | A18 | A28 | B18 | B28 | C1 | D1 | E1 | F1 |
| I-32 | A19 | A29 | B19 | B29 | C1 | D1 | E1 | F1 |

The co-polymerized polyarylate resins may have other structural units. When the entire co-polymerized polyarylate resin is designated as 100 mol %, the blending ratio of structural units represented by structural formula (7) above preferably ranges from 10 to 100 mol %, and more preferably 50 to 100 mol %.

The polyarylate resin can be synthesized by interfacial polymerization alone and more preferably synthesized by performing solution polymerization for reaction of siloxane components, followed by interfacial polymerization.

The mass-average molecular weight of the polycarbonate resin and the polyarylate resin each range from preferably 5000 to 250000, and more preferably 10000 to 150000.

The photoreceptor of the present invention may have any layer structure, as long as it satisfies the conditions concerning the above inorganic oxide and lubricant resin. The photoreceptor of the present invention is classified based on the photosensitive layer structure into a negatively charged laminate type photoreceptor, a positively charged monolayer type photoreceptor, and a positively charged laminate type photoreceptor. The negatively charged laminate type photoreceptor comprises a photosensitive layer 6 which has a charge generation layer containing a charge generation material, and, a charge transport layer containing a resin binder containing at least a charge transport material and a lubricant resin in order. The positively charged monolayer type photoreceptor comprises a photosensitive layer 3 which contains a charge transport material, a resin binder containing at least a lubricant resin, and a charge generation material. The positively charged laminate type photoreceptor comprises a photosensitive layer 7 which has a charge transport layer containing a charge transport material, and a charge generation layer containing a charge transport material, a resin binder containing at least a lubricant resin, and a charge generation material in order.

The electroconductive substrate 1 serves as a support for each layer constituting the photoreceptor as well as serving as an electrode of the photoreceptor, and may be in any shape such as a cylindrical shape, a plate shape, or a film shape. As the material of the electroconductive substrate 1, a metal such as aluminum, stainless steel, or nickel, or glass, resin, etc., the surface of which is subjected to electroconductive treatment can be used.

The undercoat layer 2 is made of a layer mainly composed of a resin or a metal oxide film such as alumite. The undercoat layer 2 is provided as necessary for purposes of, such as, controlling charge injection from the electroconductive substrate 1 to the photosensitive layer, covering defects on the surface of the electroconductive substrate 1, and improving adhesion between the photosensitive layer and the electroconductive substrate 1. Examples of the resin material used for the undercoat layer 2 include insulating polymers such as casein, polyvinyl alcohol, polyamide, melamine, and cellulose, and electroconductive polymers such as polythiophene, polypyrrole, and polyaniline. These resins can be used independently or in appropriate combinations. These resins may contain a metal oxide such as titanium dioxide or zinc oxide when used.

Negatively Charged Laminate Type Photoreceptor

In a negatively charged laminate type photoreceptor, a photosensitive layer has a charge generation layer 4 and a charge transport layer 5, wherein the charge transport layer 5 is an outermost layer.

In the negatively charged laminate type photoreceptor, the charge generation layer 4 is formed by a method that involves applying a coating solution in which particles of a charge generation material are dispersed in a resin binder, for example, and receives light to generate charges. It is important for the charge generation layer 4 to have high charge generation efficiency, and at the same time, a property of injecting the generated charges into the charge transport layer 5. The charge generation layer 4 is desired to have a low electric field dependency and a good injection property even in a low electric field.

Examples of charge generation materials include phthalocyanine compounds such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous-type titanyl phthalocyanine, and ε-type copper phthalocyanine, various azo pigments, anthanthrone pigments, thiapyrylium pigments, perylene pigments, perinone pigments, squarylium pigments, and quinacridone pigments, and these materials can be used independently or in appropriate combinations. Depending on the light wavelength region of an exposure light source to be used for image formation, a suitable substance can be selected. The charge generation layer 4 can also be used by having a charge generation material as a main component and a charge transport material or the like added thereto.

As the resin binder of the charge generation layer 4, a polymer and a copolymer etc., of a polycarbonate resin, a polyester resin, a polyamide resin, a polyurethane resin, a vinyl chloride resin, a vinyl acetate resin, a phenoxy resin, a polyvinyl acetal resin, a polyvinyl butyral resin, a polystyrene resin, a polysulfone resin, a diallyl phthalate resin, and a methacrylic ester resin can be used in appropriate combinations.

The content of the charge generation material in the charge generation layer 4 ranges from suitably 20 to 80% by mass, and more suitably 30 to 70% by mass with respect to the solid content in the charge generation layer 4. Further, the content of the resin binder in the charge generation layer 4 ranges from suitably 20 to 80% by mass, and more suitably 30 to 70% by mass with respect to the solid content in the charge generation layer 4. Since the charge generation layer 4 may be any layer as long as it has a charge generation function, its film thickness is determined based on the optical absorption coefficient of the charge generation material and is generally 1 μm or less, and suitably 0.5 μm or less.

In the case of the negatively charged laminate type photoreceptor, the charge transport layer 5 is a photosensitive layer containing the inorganic oxide and the lubricant resin. In the negatively charged laminate type photoreceptor, the charge transport layer 5 is mainly composed of the inorganic oxide, a charge transport material, and a resin binder containing at least the lubricant resin. Thereby, the desired effects of the present invention can be obtained.

As the resin binder of the charge transport layer 5, another resin is preferably used together with the lubricant resin. Particularly when the blending amount of the lubricant resin is designated as A (part(s) by mass), and the blending amount of another resin is designated as B (part(s) by mass), the ratio of the lubricant resin to the total amount of the resin binder, A/(B+A), preferably satisfies $0.1 \leq A/(B+A) \leq 0.5$, and more preferably satisfies $0.2 \leq A/(B+A) \leq 0.4$. If the ratio of the lubricant resin to the total amount of the resin binder, A/(B+A), is less than 0.1, filming takes place more easily and the same of higher than 0.5 tends to result in poor printing durability.

As such another resin, another polyarylate resin or polycarbonate resin, such as various polycarbonate resins including bisphenol A type, bisphenol Z type, bisphenol A type-biphenyl copolymer, and bisphenol Z type-biphenyl copolymer, a polyphenylene resin, a polyester resin, a polyvinyl acetal resin, a polyvinyl butyral resin, a polyvinyl alcohol resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrene resin, a polyacetal resin, a polysulfone resin, and a methacrylic acid ester, and a polymer and a copolymer etc., thereof can be used herein. Moreover, resins of the same type having different molecular weights can be mixed and used. Particularly, as another resin, a copolymerized polycarbonate resin having a repeating structure represented by the following general formula (10) can be suitably used.

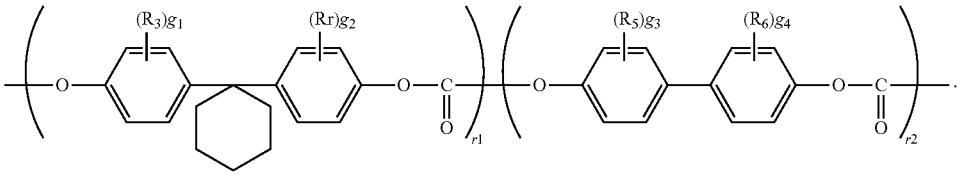

(10)

In general formula (10) above, $R_3$ to $R_6$ may be the same or different, and each represents a hydrogen atom, a C1-C10 alkyl group or a C1-C10 fluoroalkyl group, $g_1$, $g_2$, $g_3$, and $g_4$ are each an integer of 0 to 4, r1 and r2 satisfy $0.3 \leq r2/(r1+r2) \leq 0.7$, and the chain terminal group is a monovalent aromatic group or a monovalent fluorine-containing aliphatic group.

As the charge transport material of the charge transport layer 5, various hydrazone compounds, styryl compounds, diamine compounds, butadiene compounds, indole compounds, etc. can be used independently or mixed and then used in appropriate combinations. Examples of such a charge transport material include, but are not limited to, those represented by the following formulae (II-1) to (II-14).
II-1
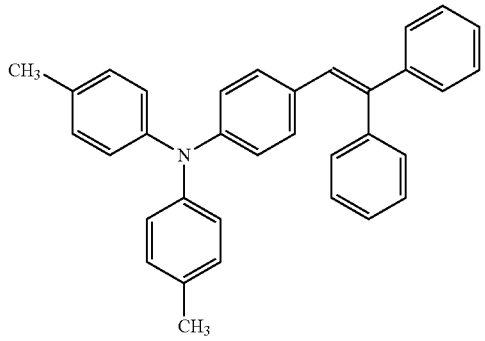
II-2
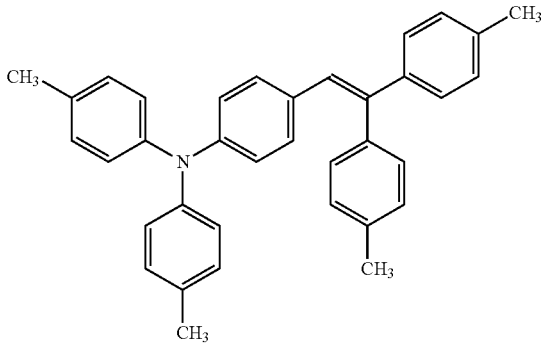
II-3
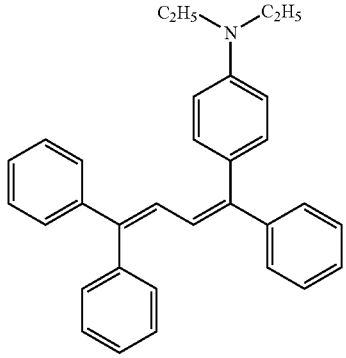
II-4
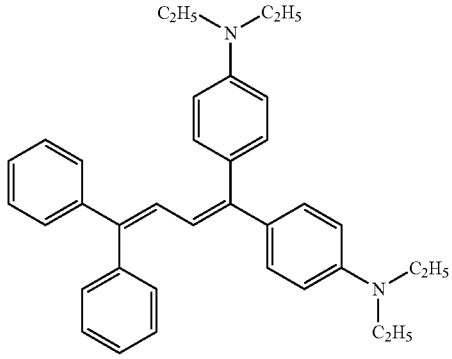
-continued
II-5
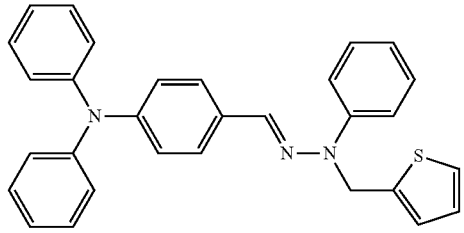
II-6
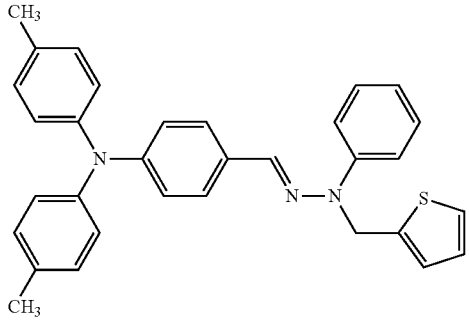
II-7
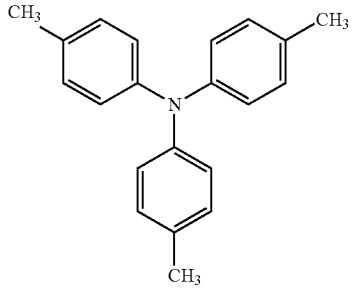
II-8
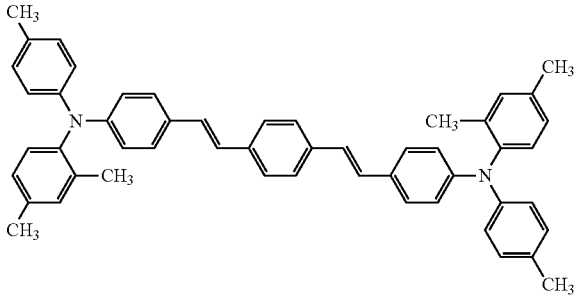
II-9
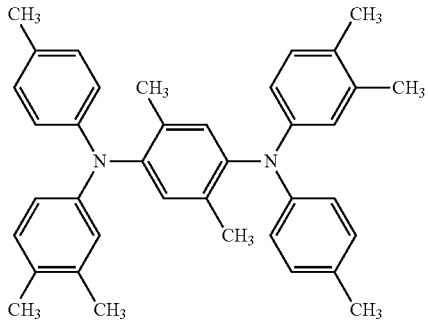

-continued

II-10

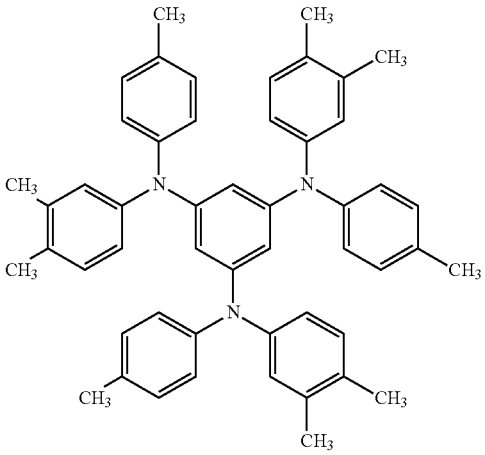

II-11

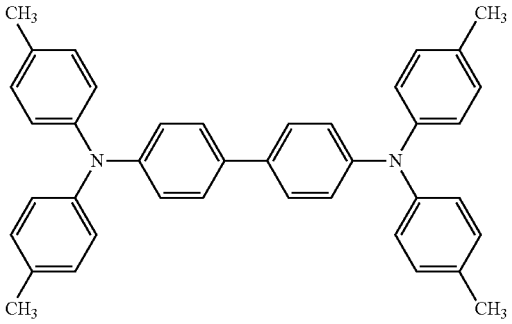

II-12

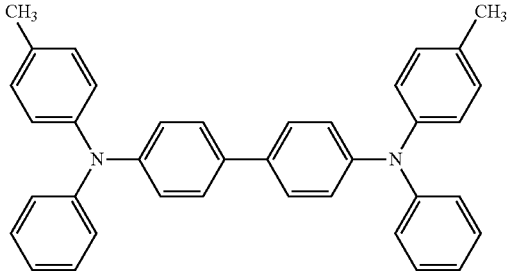

II-13

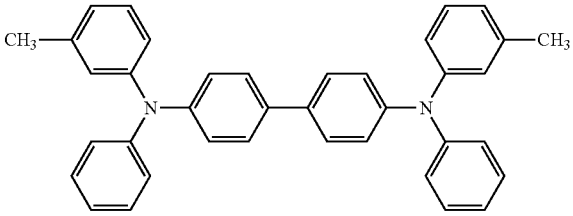

-continued

II-14

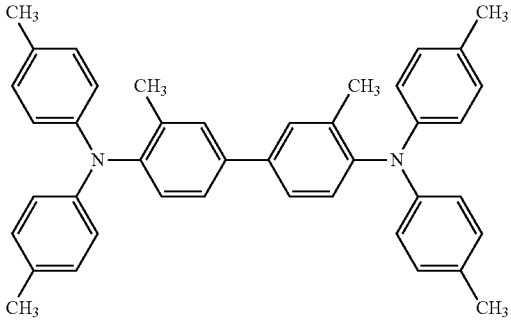

The content of the inorganic oxide in the charge transport layer 5 ranges from 1 to 40% by mass, and more preferably 2 to 30% by mass with respect to the solid content of the charge transport layer 5. The content of the resin binder in the charge transport layer 5 ranges from suitably 10 to 90% by mass, and more suitably 20 to 80% by mass with respect to the solid content of the charge transport layer 5 excluding the inorganic oxide. The content of the charge transport material in the charge transport layer 5 ranges from suitably 10 to 90% by mass, and more suitably 20 to 80% by mass with respect to the solid content of the charge transport layer 5 excluding the inorganic oxide.

Further, the film thickness of the charge transport layer 5 is preferably in the range of 3 to 50 μm and more preferably in the range of 15 to 40 μm in order to maintain a practically effective surface potential.

A solvent to be used for slurrying the inorganic oxide is not particularly limited as long as the inorganic oxide satisfies the above transmittance, and a solvent for a photosensitive layer coating solution may also be used herein. Preferably, examples thereof include, but are not limited to, tetrahydrofuran (THF), 1,3-dioxolane, tetrahydropyran, methyl ethyl ketone, methyl isobutyl ketone, cyclohexanone, toluene, methylene chloride, 1,2-dichloroethane, chlorobenzene, ethylene glycol, ethylene glycol monomethyl ether, and 1,2-dimethoxyethane, and can be used independently or in combination. Preferably, tetrahydrofuran or a mixed solvent containing the same is used.

Monolayer Type Photoreceptor

In a monolayer type photoreceptor, a photosensitive layer 3 is an outermost layer, which is a photosensitive layer containing an inorganic oxide and a lubricant resin. The monolayer type photosensitive layer 3 is mainly composed of the inorganic oxide, a charge generation material, a hole transport material, an electron transport material (acceptor compound), and a resin binder containing at least the lubricant resin. Thereby, the desired effects of the present invention can be obtained.

As the charge generation material, for example, phthalocyanine pigments, azo pigments, anthanthrone pigments, perylene pigments, perinone pigments, polycyclic quinone pigments, squarylium pigments, thiapyrylium pigments, quinacridone pigments, etc., can be used. These charge generation materials can be used independently or in combination of two or more types thereof. In particular, the azo pigment is preferably a disazo pigment or a trisazo pigment, the perylene pigment is preferably an N,N'-bis(3,5-dimethylphenyl)-3,4:9,10-perylene-bis (carboxamide), and the phthalocyanine pigment is preferably metal-free phthalocyanine, copper phthalocyanine, or titanyl phthalocyanine. Furthermore, the use of X-type metal-free phthalocyanine, τ-type metal-free phthalocyanine, ε-type copper phthalocyanine, α-type titanyl phthalocyanine, β-type titanyl phthalocyanine, Y-type titanyl phthalocyanine, amorphous titanyl phthalocyanine, and titanyl phthalocyanine having as a maximum peak Bragg angle 2θ of 9.6° in the CuKα: X-ray diffraction spectrum described in JPH08-209023A, U.S. Pat. Nos. 5,736,282A and 5,874,570A, results in significantly improved effects in terms of sensitivity, durability and image quality.

As the hole transport material, for example, hydrazone compounds pyrazoline compounds, pyrazolone compounds, oxadiazole compounds, oxazole compounds, arylamine compounds, benzidine compounds, stilbene compounds, styryl compounds, poly-N-vinyl carbazole, and polysilane, etc., can be used. These hole transport materials can be used independently or in combination of two or more types thereof. As the hole transport material, a hole transport material having good transport capacity upon photoirradiation and being suitable for combination with a charge generation material is preferred.

Examples of the electron transport material (acceptor compound) can include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanyl, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran-based compounds, quinone-based compounds, benzoquinone compounds, diphenoquinone-based compounds, naphthoquinone-based compounds, anthraquinone-based compounds, stilbenequinone-based compounds, and azoquinone-based compounds. Further, these electron transport materials can be used independently or in combination of two or more thereof.

As the resin binder of the monolayer type photosensitive layer 3, another resin is preferably used together with the lubricant resin in the same manner as that for the resin binder to be used for the charge transport layer 5 in the case of the negatively charged laminate type photoreceptor. Regarding suitable conditions for the proportion of the lubricant resin in this case, conditions similar to those for the charge transport layer 5 in the case of the negatively charged laminate type photoreceptor can be employed. Specifically, in the monolayer type photosensitive layer 3, when the blending amount of the lubricant resin is designated as A (part(s) by mass), and the blending amount of another resin is designated as B (part(s) by mass), the ratio of the lubricant resin to the total amount of the resin binder, A/(B+A), preferably satisfies $0.1 \leq A/(B+A) \leq 0.5$, and more preferably satisfies $0.2 \leq A/(B+A) \leq 0.4$.

As such another resin, another polyarylate resin or polycarbonate resin, such as various polycarbonate resins including bisphenol A type, bisphenol Z type, bisphenol A type-biphenyl copolymer, and bisphenol Z type-biphenyl copolymer, a polyphenylene resin, a polyester resin, a polyvinyl acetal resin, a polyvinyl butyral resin, a polyvinyl alcohol resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrene resin, a polyacetal resin, another polyarylate resin, a polysulfone resin, and a methacrylic acid ester, and a polymer and a copolymer etc., thereof can be used herein. Moreover, resins of the same type having different molecular weights can be mixed and used. Particularly, as another resin, a copolymerized polycarbonate resin having a repeating structure represented by general formula (10) above can be suitably used.

The content of the inorganic oxide in the monolayer type photosensitive layer 3 ranges from 1 to 40% by mass, and more suitably 2 to 30% by mass with respect to the solid content of the monolayer type photosensitive layer 3. The content of the charge generation material in the monolayer type photosensitive layer 3 ranges from suitably 0.1 to 20% by mass, and more suitably 0.5 to 10% by mass with respect to the solid content of the monolayer type photosensitive layer 3 excluding the inorganic oxide. The content of the hole transport material in the monolayer type photosensitive layer 3 ranges from suitably 3 to 80% by mass, and more suitably 5 to 60% by mass with respect to the solid content of the monolayer type photosensitive layer 3 excluding the inorganic oxide. The content of the electron transport material in the monolayer type photosensitive layer 3 ranges from suitably 1 to 50% by mass, and more suitably, 5 to 40% by mass with respect to the solid content of the monolayer type photosensitive layer 3 excluding the inorganic oxide. The content of the resin binder in the monolayer type photosensitive layer 3 ranges from suitably 10 to 90% by mass, and more suitably 20 to 80% by mass with respect to the solid content of the monolayer type photosensitive layer 3 excluding the inorganic oxide.

The film thickness of the monolayer type photosensitive layer 3 is preferably in the range of 3 to 100 μm and more preferably in the range of 5 to 40 μm in order to maintain a practically effective surface potential.

Positively Charged Laminate Type Photoreceptor

In a positively charged laminate type photoreceptor, a photosensitive layer has a charge transport layer 5 and a charge generation layer 4, wherein the charge generation layer 4 is an outermost layer.

In the positively charged laminate type photoreceptor, the charge transport layer 5 is mainly composed of a charge transport material and a resin binder. As the charge transport material to be used in the charge transport layer 5 in the positively charged laminate type photoreceptor, materials same as those listed in the embodiment of the charge transport layer 5 in the negatively charged laminate type photoreceptor can be used. The content of each material and the film thickness of the charge transport layer 5 can be the same as those of the negatively charged laminate type photoreceptor. As the resin binder of the charge transport layer 5, a lubricant resin can also be used in addition to other resins listed in the embodiment of the charge transport layer 5 in the negatively charged laminate type photoreceptor.

In the positively charged laminate type photoreceptor, the charge generation layer 4 is a photosensitive layer containing the inorganic oxide and the lubricant resin. In the positively charged laminate type photoreceptor, the charge generation layer 4 is mainly composed of the inorganic oxide, the charge generation material, the hole transport material and the electron transport material (acceptor compound) and the resin binder containing at least the lubricant resin. Thereby, the desired effects of the present invention can be obtained.

As the charge generation material, the hole transport material and the electron transport material to be used for the charge generation layer 4 in the positively charged laminate type photoreceptor, the same materials as those listed for the embodiment of the monolayer type photosensitive layer 3 in the monolayer type photoreceptor can be used. The content of each material and the film thickness of the charge generation layer 4 can be the same as those of the monolayer type photosensitive layer 3 in the monolayer type photoreceptor. In the positively charged laminate type photoreceptor, as the resin binder of the charge generation layer 4, another resin is preferably used together with the lubricant resin in the same manner as that of the resin binder to be used in the monolayer type photosensitive layer 3 in the monolayer type photoreceptor. Suitable conditions for the proportion of the lubricant resin in this case and specific examples of another resin can be the same as those for the monolayer type photosensitive layer 3 in the monolayer type photoreceptor. Specifically, in the charge generation layer 4, when the blending amount of the lubricant resin is designated as A (part(s) by mass), and the blending amount of another resin is designated as B (part(s) by mass), the ratio of the lubricant resin to the total amount of the resin binder, A/(B+A), preferably satisfies $0.1 \leq A/(B+A) \leq 0.5$, and more preferably satisfies $0.2 \leq A/(B+A) \leq 0.4$.

Any of the above laminate type and monolayer type photosensitive layers may contain a deterioration preventing agent such as an antioxidant or a light stabilizer for the purpose of improving environmental resistance and stability against harmful light. Examples of compounds to be used for these purposes include chromanol derivatives such as tocopherol and esterified compounds, polyarylalkane compounds, hydroquinone derivatives, etherified compounds, dietherified compounds, benzophenone derivatives, benzotriazole derivatives, thioether compounds, phenylenediamine derivatives, phosphonic acid esters, phosphorous acid esters, phenol compounds, hindered phenol compounds, linear amine compounds, cyclic amine compounds, and hindered amine compounds.

The above photosensitive layer can also contain a leveling agent such as silicone oil or fluorine-based oil for the purpose of improving the leveling property of the formed film and imparting lubricity. Furthermore, the photosensitive layer may also contain metal oxides such as silicon oxide (silica), titanium oxide, zinc oxide, calcium oxide, aluminum oxide (alumina), and zirconium oxide, metal sulfates such as barium sulfate and calcium sulfate, fine particles of metal nitrides such as silicon nitride and aluminum nitride, particles of fluorine-based resins such as a tetrafluoroethylene resin, a fluorine-based comb-type graft polymerization resin, or the like for the purpose of adjusting the film hardness, reducing the friction coefficient, and imparting lubricity, for example. Furthermore, if necessary, other known additives can also be contained as long as the electrophotographic characteristics are not significantly impaired.

Method for Producing the Photoreceptor

Figure 2:
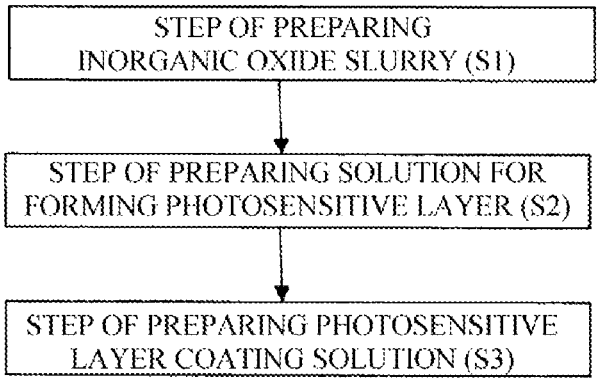
FIG. 2 is a flow chart illustrating an example of a method for producing an electrophotographic photoreceptor of the present invention.

A production method of an embodiment of the present invention includes steps below when a photoreceptor is produced by forming a photosensitive layer containing an inorganic oxide and a lubricant resin using a photosensitive layer coating solution. Specifically, as shown in FIG. 2, first, the inorganic oxide is primarily dispersed in a solvent for the photosensitive layer coating solution, so as to obtain an inorganic oxide slurry (step of preparing an inorganic oxide slurry (S1)). Next, a charge transport material and the lubricant resin are dissolved in the solvent for the photosensitive layer coating solution, so as to obtain a solution for forming a photosensitive layer (step of preparing a solution for forming a photosensitive layer (S2)). Thereafter, the thus obtained inorganic oxide slurry and the solution for forming a photosensitive layer are mixed, so as to obtain a photosensitive layer coating solution (step of preparing a photosensitive layer coating solution (S3)). This makes it possible to reliably produce a photoreceptor that can realize a stable image with little wear even after long-term use and without filming.

Here, the solution for forming a photosensitive layer contains at least a charge transport material and a lubricant resin. For example, when the photosensitive layer containing an inorganic oxide and the lubricant resin is a negatively charged laminate type photosensitive layer, the solution for forming a photosensitive layer is prepared by dissolving a charge transport material and a resin binder containing at least a lubricant resin in a solvent for a photosensitive layer coating solution. Further, when the photosensitive layer containing an inorganic oxide and a lubricant resin is a monolayer type photosensitive layer and when the same is a positively charged laminate type photosensitive layer, the solution for forming a photosensitive layer is prepared by dissolving a hole transport material, an electron transport material, and a resin binder containing at least a lubricant resin in a solvent for a photosensitive layer coating solution, and then dispersing (secondary dispersion) a charge generation material.

Examples of the solvent for a photosensitive layer coating solution preferably include tetrahydrofuran (THF), 1,3-dioxolane, tetrahydropyran, methyl ethyl ketone, methyl isobutyl ketone, cyclohexanone, toluene, methylene chloride, 1,2-dichloroethane, chlorobenzene, ethylene glycol, ethylene glycol monomethyl ether, and 1,2-dimethoxyethane, and these examples can be used independently or in combination. Preferably, tetrahydrofuran or a mixed solvent containing the same is used. A solvent for a photosensitive layer coating solution may be the same solvent to be used for slurrying an inorganic oxide.

When the inorganic oxide slurry is mixed with other constituents of the photosensitive layer, dissolution and dispersion can be performed in an arbitrary order. For example, a method that involves preparing the solution for forming a photosensitive layer and then adding the solution to the inorganic oxide slurry can be employed.

Further, the preparation of an inorganic oxide slurry can be performed according to a standard method using the above-mentioned disperser as appropriate, and is not particularly limited. Further, the preparation of a solution for forming a photosensitive layer and that of a photosensitive layer coating solution can also be performed according to standard methods as appropriate, and are not particularly limited.

Electrophotographic Apparatus

An electrophotographic apparatus of an embodiment of the present invention is mounted with the electrophotographic photoreceptor, and the desired effects can be obtained by applying various machine processes. Specifically, sufficient effects can be obtained through a charging process such as a contact charging system using a charging member such as a roller or a brush, a non-contact charging system using corotron or scorotron, etc., and, a developing process such as contact development and non-contact development systems using a non-magnetic one-component, magnetic one-component, or two-component development system, etc. In particular, the present invention including a contact-charging-system charging process, by which a charging member is contacted with a photoreceptor for charging, is useful in that wear due to contact with the charging member can be suppressed.

Figure 3:
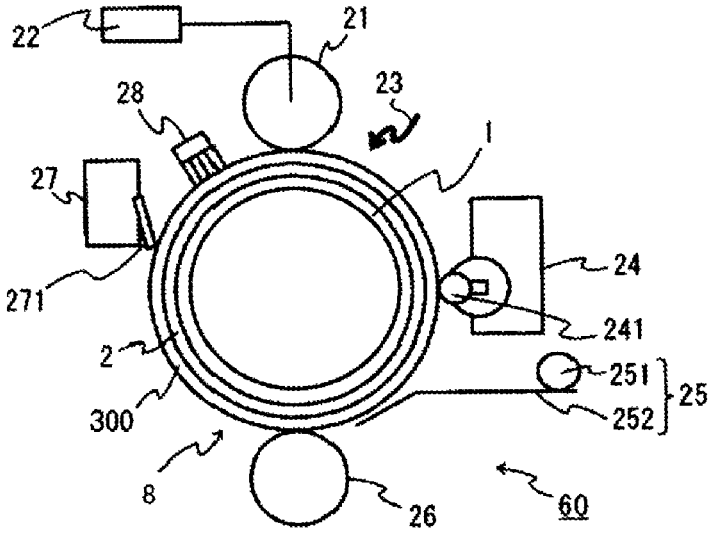
FIG. 3 is a schematic configuration diagram showing a configuration example of an electrophotographic apparatus of the present invention.

FIG. 3 is a schematic configuration diagram showing a configuration example of the electrophotographic apparatus of an embodiment of the present invention. An electrophotographic apparatus 60 shown in the figure includes a photoreceptor 8 of an embodiment of the present invention mounted therein containing an electroconductive substrate 1, a undercoat layer 2 and a photosensitive layer 300 applied on the outer peripheral surface. The electrophotographic apparatus 60 is composed of a charging member 21 disposed on the outer peripheral edge of the photoreceptor 8, a high voltage power supply 22 for feeding applied voltage to the charging member 21, an image exposure member 23, a developing device 24 including a developing roller 241, a paper feed member 25 including a paper feed roller 251 and a paper feed guide 252, and a transfer charger (direct charging type) 26. The electrophotographic apparatus 60 may further contain a cleaning device 27 including a cleaning blade 271 and a discharge member 28. Further, the electrophotographic apparatus 60 can be a color printer.

EXAMPLES

Hereinafter, specific embodiments of the present invention will be described in more detail using Examples. The present invention is not limited by the following examples unless it exceeds the gist.

Preparation of Inorganic Oxide Slurry

Production Examples 1 to 20

According to production examples listed in Table 2 below, inorganic oxide slurries were prepared. Specifically, each inorganic oxide slurry was obtained by surface-treating each silica manufactured by Admatechs Company Limited, (YA010C (aluminum element content: 500 ppm), YA050C (aluminum element content: 900 ppm), YA100C (aluminum element content: 900 ppm), YA180C (aluminum element content: 900 ppm), and YA400C (aluminum element content: 900 ppm)) as an inorganic oxide using a treatment agent listed in Table 2 as a surface treatment agent to prepare surface-treated silica, and then dispersing the silica (primary dispersion) in tetrahydrofuran (THF) for a photosensitive layer coating solution. The inorganic oxide after surface treatment in Production Example 1 was subjected to the quantitative determination of the amount of the surface treatment agent, and thus the amount was 0.8% by mass with respect to the inorganic oxide after treatment.

TABLE 2

| | Inorganic oxide | | Surface treatment agent | | Inorganic oxide slurry | |
|---|---|---|---|---|---|---|
| | Type | Primary particle diameter (nm) | Surface treatment agent 1 | Surface treatment agent 2 | Solvent type | Concentration of inorganic oxide (wt %) |
| Production Example 1 | Silica A*1 | 10 | Phenyl trimethoxysilane | — | THF | 20 |
| Production Example 2 | Silica A | 10 | KBM573*6 | — | THF | 20 |
| Production Example 3 | Silica A | 10 | Phenyl trimethoxysilane | KBM573 | THF | 20 |
| Production Example 4 | Silica A | 10 | KBM573 | KBM903*7 | THF | 20 |
| Production Example 5 | Silica B*2 | 50 | Phenyl trimethoxysilane | — | THF | 20 |
| Production Example 6 | Silica B | 50 | KBM573 | — | THF | 20 |
| Production Example 7 | Silica B | 50 | Phenyl trimethoxysilane | KBM573 | THF | 20 |
| Production Example 8 | Silica B | 50 | KBM573 | KBM903 | THF | 20 |
| Production Example 9 | Silica C*3 | 100 | Phenyl trimethoxysilane | — | THF | 20 |
| Production Example 10 | Silica C | 100 | KBM573 | — | THF | 20 |
| Production Example 11 | Silica C | 100 | Phenyl trimethoxysilane | KBM573 | THF | 20 |
| Production Example 12 | Silica C | 100 | KBM573 | KBM903 | THF | 20 |
| Production Example 13 | Silica D*4 | 180 | Phenyl trimethoxysilane | — | THF | 20 |
| Production Example 14 | Silica D | 180 | KBM573 | — | THF | 20 |
| Production Example 15 | Silica D | 180 | Phenyl trimethoxysilane | KBM573 | THF | 20 |
| Production Example 16 | Silica D | 180 | KBM573 | KBM903 | THF | 20 |
| Production Example 17 | Silica E*5 | 400 | Phenyl trimethoxysilane | — | THF | 20 |
| Production Example 18 | Silica E | 400 | KBM573 | — | THF | 20 |

TABLE 2-continued

| | Inorganic oxide | | Surface treatment agent | | Inorganic oxide slurry | |
|---|---|---|---|---|---|---|
| | Type | Primary particle diameter (nm) | Surface treatment agent 1 | Surface treatment agent 2 | Solvent type | Concentration of inorganic oxide (wt %) |
| Production Example 19 | Silica E | 400 | Phenyl trimethoxysilane | KBM573 | THF | 20 |
| Production Example 20 | Silica E | 400 | KBM573 | KBM903 | THF | 20 |

*1Silica A: Manufactured by Admatechs Company Limited, YA010C, primary particle diameter: 10 nm;
*2Silica B: Manufactured by Admatechs Company Limited, YA050C, primary particle diameter: 50 nm;
*3Silica C: Manufactured by Admatechs Company Limited, YA100C, primary particle diameter: 100 nm;
*4Silica D: Manufactured by Admatechs Company Limited, YA180C, primary particle diameter: 180 nm;
*5Silica E: Manufactured by Admatechs Company Limited, YA400C, primary particle diameter: 400 nm;
*6KBM573: Manufactured by Shin-Etsu Chemical Co., Ltd., N-phenyl-3-aminopropyltrimethoxysilane; and
*7KBM903: Manufactured by Shin-Etsu Chemical Co., Ltd.

Production of Negatively Charged Laminate Type Photoreceptor

Example 1

A coating solution 1 was prepared by dissolving and dispersing 5 parts by mass of alcohol-soluble nylon (trade name "CM8000" manufactured by Toray Industries, Inc.) and 5 parts by mass of aminosilane-treated titanium oxide fine particles in 90 parts by mass of methanol. The outer periphery of an aluminum cylinder having an outer diameter of 30 mm as the electroconductive substrate was dip-coated with the coating liquid 1, and then the resultant was dried at a temperature of 100° C. for 30 minutes, thereby forming an undercoat layer having a thickness of 3 μm.

One part by mass of Y-type titanyl phthalocyanine as a charge generation material and 1.5 parts by mass of a polyvinyl butyral resin (trade name "ESREC BM-2" manufactured by Sekisui Chemical Co., Ltd.) as a resin binder were dissolved and dispersed in 60 parts by mass of dichloromethane, thereby preparing a coating solution 2. The undercoat layer was dip-coated with the coating solution 2. After 30 minutes of drying at a temperature of 80° C., a charge generation layer having a film thickness of 0.3 μm was formed.

Nine parts by mass of a compound represented by the following structural formula as a charge transport material (CTM),

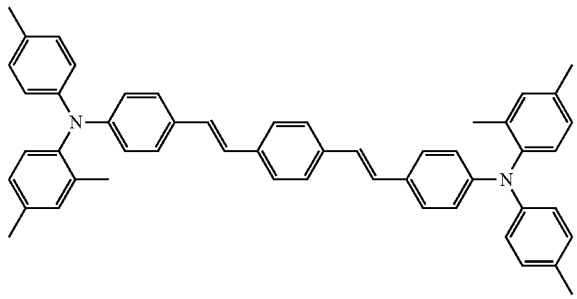

8 parts by mass of a polycarbonate resin having a repeating unit represented by the following structural formula as a resin binder 1, and

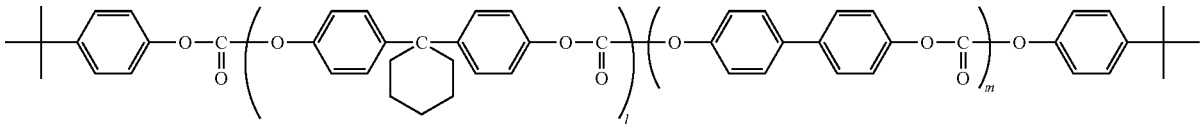

l/(l + m) = 0.6
m/(l + m) = 0.4

3 parts by mass of a polycarbonate resin having a repeating unit represented by the following structural formula as a resin binder 2,

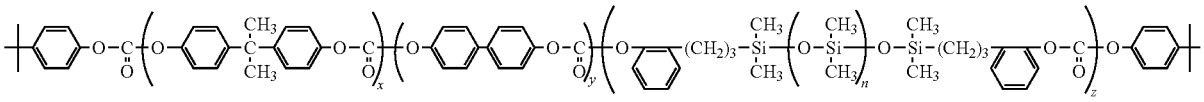

x/(x + y + z) = 0.85
z/(x + y + z) = 0.003 were dissolved in 80 parts by mass of THF. The solution was added to 25 parts by mass of the inorganic oxide slurry prepared in Production Example 1, thereby preparing a coating solution 3. The charge generation layer was dip-coated with the coating solution 3, and then the resultant was dried at a temperature of 120° C. for 60 minutes to form a charge transport layer having a film thickness of 20 m, thereby preparing a negatively charged laminate type photoreceptor.

Example 2

A photoreceptor was prepared in the same manner as in Example 1 except for using a polycarbonate resin having a repeating unit represented by the following structural formula as a resin binder 3 instead of the resin binder 2 used in Example 1.

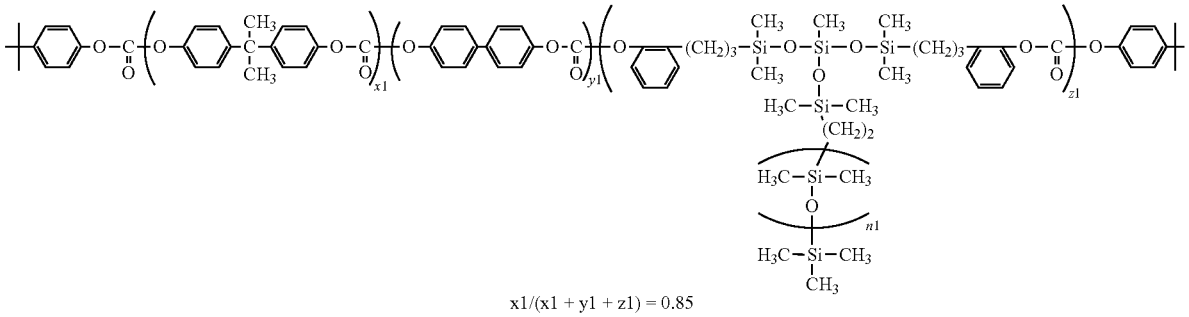

x1/(x1 + y1 + z1) = 0.85
z1/(x1 + y1+ z1) = 0.003

Example 3

A photoreceptor was prepared in the same manner as in Example 1 except for using a polyarylate resin having a repeating unit represented by the following structural formula as a resin binder 4 instead of the resin binder 2 used in Example 1.

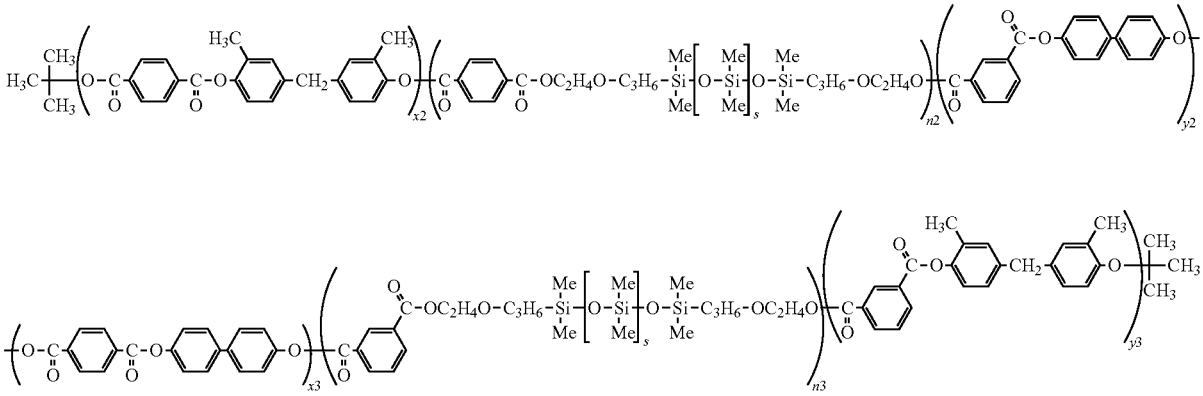

x2/(x2 + y2 + x3 + y3 + n2 + n3) = 0.36
y2/(x2 + y2 + x3 + y3 + n2 + n3) = 0.44

Example 4

A photoreceptor was prepared in the same manner as in Example 1 except for using a polycarbonate resin having a repeating unit represented by the following structural formula as a resin binder 5 instead of the resin binder 2 used in Example 1.

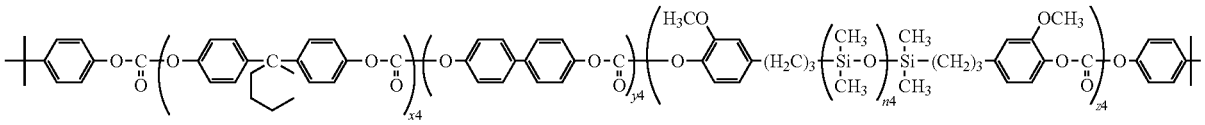

x4/(x4 + y4 + z4) = 0.85
z4/(x4 + y4 +z4) = 0.003

Examples 5 to 23

Photoreceptors were prepared in the same manner as in Example 1 except for varying the type of the inorganic oxide slurry of Production Example 1 used in Example 1 according to Table 3 below.

Comparative Example 1

A photoreceptor was prepared in the same manner as in Example 1 except for using only the resin binder 1 as the resin used for the coating solution 3 in Example 1 and changing the addition amount thereof to 11 parts by mass.

Example 24

A photoreceptor was prepared in the same manner as in Example 1 except for using 10 parts by mass of the resin binder 1 and 1 part by mass of the resin binder 2 instead of the resin used for the coating solution 3 in Example 1.

Example 25

A photoreceptor was prepared in the same manner as in Example 1 except for using 10 parts by mass of the resin binder 1 and 1 part by mass of the resin binder 3 instead of the resin used for the coating solution 3 in Example 1.

Example 26

A photoreceptor was prepared in the same manner as in Example 1 except for using 10 parts by mass of the resin binder 1 and 1 part by mass of the resin binder 4 instead of the resin used for the coating solution 3 in Example 1.

Comparative Example 2

A photoreceptor was prepared in the same manner as in Example 1 except for using 5 parts by mass of the resin binder 1 and 6 parts by mass of the resin binder 2 instead of the resin used for the coating solution 3 in Example 1.

Comparative Example 3

A photoreceptor was prepared in the same manner as in Example 1 except for using 11 parts by mass of a polycarbonate resin having a repeating unit represented by a structural formula below as a resin binder 6 instead of the resin used for the coating solution 3 in Example 1.

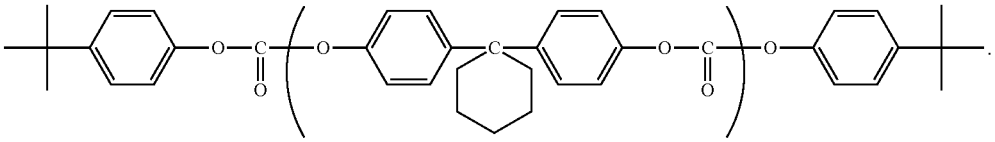

Comparative Example 4

A photoreceptor was prepared in the same manner as in Example 1 except for using the inorganic oxide slurry of Production Example 5 instead of the inorganic oxide slurry of Production Example 1 used for the coating solution 3 in Example 1, using only the polycarbonate resin binder 1, and changing the addition amount thereof to 11 parts by mass.

Comparative Example 5

A photoreceptor was prepared in the same manner as in Example 1 except for using the inorganic oxide slurry of Production Example 9 instead of the inorganic oxide slurry of Production Example 1 used for the coating solution 3 in Example 1, using only the polycarbonate resin binder 1, and changing the addition amount thereof to 11 parts by mass.

Comparative Example 6

A photoreceptor was prepared in the same manner as in Example 1 except for using the inorganic oxide slurry of Production Example 13 instead of the inorganic oxide slurry of Production Example 1 used for the coating solution 3 in Example 1, using only the polycarbonate resin binder 1, and changing the addition amount thereof to 11 parts by mass.

Production of Positively Charged Monolayer Type Photoreceptor

Example 27

Zero point two (0.2) parts by mass of a vinyl chloride-vinyl acetate-vinyl alcohol copolymer (manufactured by Nissin Chemical Industry Co., Ltd., trade name "SOLBIN TA5R") was dissolved in and stirred with 99 parts by mass of methyl ethyl ketone, thereby preparing a coating solution 4. The coating solution 4 was applied onto the outer periphery of an aluminum cylinder having an outer diameter of 24 mm as an electroconductive substrate by dip-coating, and then the resultant was dried at a temperature of 100° C. for 30 minutes, thereby forming an undercoat layer having a film thickness of 0.1 μm.

Zero point one (0.1) parts by mass of X-type metal-free phthalocyanine as a charge generation material, 8 parts by mass of the charge transport material (CTM) used in Example 1 as a hole transport material, 4 parts by mass of a compound having a structure represented by the following structural formula as an electron transport material (ETM):

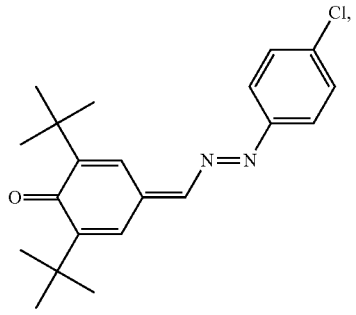

6 parts by mass of a polycarbonate resin as the resin binder 1 used for the charge transport layer of Example 1, and 2 parts by mass of a polycarbonate resin as the resin binder 2 used for the charge transport layer of Example 1 were dissolved and dispersed in 80 parts by mass of THF. The solution was added to 25 parts by mass of the inorganic oxide slurry prepared in Production Example 1, thereby preparing a coating solution 5.

The coating solution 5 was applied onto the undercoat layer by dip-coating and then the resultant was dried at a temperature of 100° C. for 60 minutes to form a photosensitive layer having a film thickness of 25 μm, thereby preparing a monolayer type photoreceptor.

Example 28

A photoreceptor was prepared in the same manner as in Example 27 except for using the inorganic oxide slurry of Production Example 10 instead of the inorganic oxide slurry used in Example 27.

Comparative Example 7

A photoreceptor was prepared in the same manner as in Example 27 except for using only the resin binder 1 as the resin used in Example 27 and changing the addition amount thereof to 8 parts by mass.

Comparative Example 8

A photoreceptor was prepared in the same manner as in Example 27 except for using only the resin binder 1 as the resin used in Example 27, changing the addition amount thereof to 8 parts by mass, and using the inorganic oxide slurry of Production Example 10.

Production of Positively Charged Laminate Type Photoreceptor

Example 29

Five (5) parts by mass of a polycarbonate resin as the resin binder 1 used in Example 27 and 5 parts by mass of the charge transport material used in Example 1 were dissolved in 80 parts by mass of THF, thereby preparing a coating solution 6. The outer periphery of an aluminum cylinder having an outer diameter of 24 mm as an electroconductive substrate was dip-coated with the coating solution 6, and then the resultant was dried at a temperature of 120° C. for 60 minutes, thereby forming a charge transport layer having a film thickness of 15 μm.

Zero point one (0.1) parts by mass of Y-type titanyl phthalocyanine as a charge generation material, 2 parts by mass of the charge transport material (CTM) used in Example 1 as a hole transport material, 5 parts by mass of the compound used in Example 27 as an electron transport material (ETM), 10 parts by mass of a polycarbonate resin as the resin binder 1 used in Example 1, and 3 parts by mass of a polycarbonate resin as the resin binder 2 used in Example 1 were dissolved and dispersed in 120 parts by mass of 1,2-dichloroethane. The solution was added to 25 parts by mass of the inorganic oxide slurry prepared in Production Example 1, thereby preparing a coating solution 7. The coating solution 7 was applied onto the charge transport layer by dip-coating, and then the resultant was dried at a temperature of 100° C. for 60 minutes to form a charge generation layer having a film thickness of 15 μm, thereby preparing a positively charged laminate type photoreceptor.

Example 30

A photoreceptor was prepared in the same manner as in Example 29 except for using the inorganic oxide slurry of Production Example 10 instead of the inorganic oxide slurry used in Example 29.

Comparative Example 9

A photoreceptor was prepared in the same manner as in Example 29 except for using only resin binder 1 as the resin used in Example 29, and changing the addition amount thereof to 13 parts by mass.

Comparative Example 10

A photoreceptor was prepared in the same manner as in Example 29 except for using only the resin binder 1 as the resin used in Example 29, changing the addition amount thereof to 13 parts by mass, and using the inorganic oxide slurry of Production Example 10.

Transmittance of Inorganic Oxide Slurry

For the inorganic oxide slurry of each production example, a slurry for evaluation was prepared by primarily dispersing 20% by mass of an inorganic oxide in THF. These samples are each referred to as a 20% by mass inorganic oxide slurry. A slurry for evaluation was placed in a quartz cell having an optical path length of 10 mm, and the luminous transmittance when irradiated with light having a wavelength of 780 nm was measured with a spectrophotometer (UV-3100, manufactured by Shimadzu Corporation). These luminous transmittances are also referred to as slurry transmittances. The measurement results are also shown in Table 3.

Viscosity of the Inorganic Oxide Slurry

For the inorganic oxide slurry of each production example, a 20% by mass inorganic oxide slurry for evaluation was prepared by dispersing 20% by mass of an inorganic oxide in THF. The viscosities at 20° C. of these 20% by mass inorganic oxide slurries were measured with a vibration viscometer (VISCOMATE VM-10A manufactured by SEKONIC). These viscosities are also referred to as the viscosities of slurry liquids. The measurement results are shown in Table 3.

Evaluation of the Photoreceptor

The electric characteristics, wear resistance (wear amount) and filming resistance of the photoreceptors prepared in Examples 1 to 30 and Comparative Examples 1 to 10 above were evaluated by the following methods. The evaluation results are also shown in Table 4.

Electric Characteristics

The electric characteristics of the photoreceptors obtained in each Example and Comparative Example were evaluated by the following method using a process simulator (CYNTHIA91) manufactured by GENTEC CO., LTD.

The surfaces of the photoreceptors of Examples 1 to 26 and Comparative Examples 1 to 6 were charged to −650 V by corona discharge in the dark under an environment of a temperature of 22° C. and a humidity of 50%, and then the surface potential V0 was measured immediately after charging. Subsequently, the photoreceptors were left to stand for 5 seconds in the dark, the surface potential V5 was measured, and then potential retention rate Vk5(%) was found 5 seconds after charging according to the following calculation formula (1):

$$Vk5=V5/V0\times 100 \quad (1).$$

Next, exposure light of 1.0 μW/cm$^2$ spectrally split with a filter at 780 nm was irradiated using a halogen lamp as a light source to each photoreceptor for 5 seconds at the time when the surface potential was −600V. The exposure amount required for light attenuation to take place and thus for the surface potential to reach −300V after 5 seconds of irradiation was represented by E1/2 (μJ/cm$^2$) and the residual potential of the photoreceptor surface after 5 seconds of exposure was represented by Vr5 (V) for evaluation.

For the photoreceptors of Examples 27 to 30 and Comparative Examples 7 to 10, the charging potential was set at +650 V, the exposure light was irradiated at the time point when the surface potential was +600 V, the exposure amount required for the surface potential to be +300 V was represented by E1/2, and then evaluation was made in the same manner as described above.

(Evaluation of Wear Resistance)

The photoreceptors prepared in Examples 1 to 26 and Comparative Examples 1 to 6 were each mounted on an HP printer LJ4250, 10000 sheets of A4 paper were printed, the film thickness of each photoreceptor was measured before and after printing, and then the average wear amount (μm) after printing was evaluated.

Further, the photoreceptors prepared in Examples 27 to 30 and Comparative Examples 7 to 10 were each mounted on a Brother Printer HL-2040, 10000 sheets of A4 paper were printed, the film thickness of each photoreceptor was measured before and after printing, and then the average wear amount (μm) after printing was evaluated.

Evaluation of Filming

Filming was evaluated by determining the presence or the absence of toner adhesion to the photoreceptor surfaces after repeated printing. Those observed to have no toner adhesion were evaluated as ○, those observed to have toner adhesion to some extent were evaluated as Δ, and those clearly observed to have toner adhesion were evaluated as x.

TABLE 3

| | Slurry conditions | | | | Composition of coating solution (number of parts) | | | | | | | |
|---|---|---|---|---|---|---|---|---|---|---|---|---|
| | Slurry used | Transmittance (%) | Viscosity (mPa · s) | Amount of slurry added (parts by mass) | CTM | ETM | Resin 1 | Resin 2 | Resin 3 | Resin 4 | Resin 5 | Resin 6 |
| Example 1 | Production Example 1 | 96 | 1.1 | 25 | 9 | — | 8 | 3 | — | — | — | — |
| Example 2 | Production Example 1 | 96 | 1.1 | 15 | 9 | — | 8 | — | 3 | — | — | — |

TABLE 3-continued

| | Slurry conditions | | | | Composition of coating solution (number of parts) | | | | | | | |
|---|---|---|---|---|---|---|---|---|---|---|---|---|
| | Slurry used | Transmittance (%) | Viscosity (mPa · s) | Amount of slurry added (parts by mass) | CTM | ETM | Resin 1 | Resin 2 | Resin 3 | Resin 4 | Resin 5 | Resin 6 |
| Example 3 | Production Example 1 | 96 | 1.1 | 15 | 9 | — | 8 | — | — | 3 | — | — |
| Example 4 | Production Example 1 | 96 | 1.1 | 15 | 9 | — | 8 | — | — | — | 3 | — |
| Example 5 | Production Example 2 | 97 | 1.3 | 15 | 9 | — | 8 | — | — | — | — | — |
| Example 6 | Production Example 3 | 95 | 1.5 | 15 | 9 | — | 8 | — | — | — | — | — |
| Example 7 | Production Example 4 | 96 | 1.4 | 15 | 9 | — | 8 | — | — | — | — | — |
| Example 8 | Production Example 5 | 95 | 1.3 | 15 | 9 | — | 8 | — | — | — | — | — |
| Example 9 | Production Example 6 | 90 | 1.6 | 15 | 9 | — | 8 | — | — | — | — | — |
| Example 10 | Production Example 7 | 92 | 1.5 | 15 | 9 | — | 8 | — | — | — | — | — |
| Example 11 | Production Example 8 | 94 | 1.3 | 15 | 9 | — | 8 | — | — | — | — | — |
| Example 12 | Production Example 9 | 96 | 1.2 | 15 | 9 | — | 8 | — | — | — | — | — |
| Example 13 | Production Example 10 | 97 | 1.6 | 25 | 9 | — | 8 | — | — | — | — | — |
| Example 14 | Production Example 11 | 93 | 1.5 | 15 | 9 | — | 8 | — | — | — | — | — |
| Example 15 | Production Example 12 | 94 | 1.7 | 15 | 9 | — | 8 | — | — | — | — | — |
| Example 16 | Production Example 13 | 97 | 1.3 | 15 | 9 | — | 8 | — | — | — | — | — |
| Example 17 | Production Example 14 | 95 | 1.9 | 15 | 9 | — | 8 | — | — | — | — | — |
| Example 18 | Production Example 15 | 94 | 1.6 | 15 | 9 | — | 8 | — | — | — | — | — |
| Example 19 | Production Example 16 | 98 | 1.4 | 15 | 9 | — | 8 | — | — | — | — | — |
| Example 20 | Production Example 17 | 93 | 1.8 | 15 | 9 | — | 8 | — | — | — | — | — |
| Example 21 | Production Example 18 | 96 | 1.7 | 15 | 9 | — | 8 | — | — | — | — | — |
| Example 22 | Production Example 19 | 95 | 1.3 | 15 | 9 | — | 8 | — | — | — | — | — |
| Example 23 | Production Example 20 | 94 | 1.5 | 25 | 9 | — | 8 | — | — | — | — | — |
| Comparative Example 1 | Production Example 1 | 96 | 1.1 | 25 | 9 | — | 11 | — | — | — | — | — |
| Example 24 | Production Example 1 | 96 | 1.1 | 15 | 9 | — | 10 | 1 | — | — | — | — |
| Example 25 | Production Example 1 | 96 | 1.1 | 15 | 9 | — | 10 | — | 1 | — | — | — |

TABLE 4

| | Electric characteristics | | | | | |
|---|---|---|---|---|---|---|
| | Potential retention rate Vk5 (%) | Sensitivity E1/2 (μJ/cm²) | Residual potential Vr5 (V) | Wear amount (μm) | Filming resistance Initial | Filming resistance After printing |
| Example 1 | 92.3 | 0.15 | 25 | 1.6 | ○ | ○ |
| Example 2 | 92.1 | 0.16 | 21 | 1.5 | ○ | ○ |
| Example 3 | 92.5 | 0.14 | 22 | 1.8 | ○ | ○ |
| Example 4 | 91.8 | 0.13 | 23 | 1.7 | ○ | ○ |
| Example 5 | 92.0 | 0.15 | 20 | 1.5 | ○ | ○ |
| Example 6 | 92.3 | 0.16 | 24 | 1.7 | ○ | ○ |
| Example 7 | 91.8 | 0.17 | 21 | 1.8 | ○ | ○ |
| Example 8 | 92.0 | 0.16 | 20 | 1.6 | ○ | ○ |

TABLE 4-continued

| | Electric characteristics | | | | | |
|---|---|---|---|---|---|---|
| | Potential retention rate Vk5 (%) | Sensitivity E1/2 (μJ/cm²) | Residual potential Vr5 (V) | Wear amount (μm) | Filming resistance Initial | Filming resistance After printing |
| Example 9 | 93.3 | 0.18 | 22 | 1.7 | ○ | ○ |
| Example 10 | 94 | 0.15 | 27 | 1.6 | ○ | ○ |
| Example 11 | 94.5 | 0.18 | 29 | 1.7 | ○ | ○ |
| Example 12 | 93.9 | 0.14 | 22 | 1.5 | ○ | ○ |
| Example 13 | 94.2 | 0.16 | 23 | 1.6 | ○ | ○ |
| Example 14 | 93.9 | 0.15 | 20 | 1.7 | ○ | ○ |
| Example 15 | 91.8 | 0.16 | 22 | 1.8 | ○ | ○ |
| Example 16 | 94.5 | 0.13 | 23 | 1.7 | ○ | ○ |

TABLE 4-continued

| | Electric characteristics | | | | Filming resistance | |
|---|---|---|---|---|---|---|
| | Potential retention rate Vk5 (%) | Sensitivity E1/2 (μJ/cm²) | Residual potential Vr5 (V) | Wear amount (μm) | Initial | After printing |
| Example 17 | 93.4 | 0.16 | 28 | 1.4 | ○ | ○ |
| Example 18 | 93.5 | 0.17 | 30 | 1.3 | ○ | ○ |
| Example 19 | 93.2 | 0.18 | 21 | 1.6 | ○ | ○ |
| Example 20 | 92.7 | 0.16 | 30 | 1.5 | ○ | ○ |
| Example 21 | 92.4 | 0.15 | 26 | 1.6 | ○ | ○ |
| Example 22 | 93.1 | 0.16 | 23 | 1.7 | ○ | ○ |
| Example 23 | 94.3 | 0.16 | 25 | 1.5 | ○ | ○ |
| Comparative Example 1 | 92.4 | 0.17 | 31 | 1.4 | ○ | X |
| Example 24 | 93.1 | 0.16 | 28 | 1.7 | ○ | Δ |
| Example 25 | 92.5 | 0.17 | 25 | 1.8 | ○ | Δ |
| Example 26 | 91.9 | 0.15 | 26 | 1.7 | ○ | Δ |
| Comparative Example 2 | 91.7 | 0.16 | 27 | 3.0 | ○ | ○ |
| Comparative Example 3 | 92.5 | 0.17 | 28 | 3.1 | ○ | ○ |
| Comparative Example 4 | 92.7 | 0.18 | 24 | 1.6 | ○ | X |
| Comparative Example 5 | 91.3 | 0.17 | 29 | 1.5 | ○ | X |
| Comparative Example 6 | 91.2 | 0.18 | 31 | 1.7 | ○ | X |
| Example 27 | 92 | 0.18 | 25 | 1.6 | ○ | ○ |
| Example 28 | 92 | 0.17 | 27 | 1.8 | ○ | ○ |
| Example 29 | 91.3 | 0.18 | 26 | 1.7 | ○ | ○ |
| Example 30 | 90.8 | 0.17 | 29 | 1.5 | ○ | ○ |
| Comparative Example 7 | 91.3 | 0.18 | 30 | 1.6 | ○ | X |
| Comparative Example 8 | 91 | 0.16 | 28 | 1.7 | ○ | X |
| Comparative Example 9 | 90.7 | 0.18 | 34 | 1.7 | ○ | X |
| Comparative Example 10 | 90.5 | 0.18 | 32 | 1.6 | ○ | X |

As is understood from the results in Tables 3 and 4 above, the photoreceptors of Examples 1 to 30 produced using inorganic oxides having high transmittance and low viscosity in the form of the inorganic oxide slurries and lubricant resins have good wear resistance and good electric characteristics, and cause no filming at both initial and after printing of 10000 sheets. On the other hand, when no lubricant resin was added in Comparative Examples 1 and 4 to 10, it was confirmed that wear resistance was good, but filming took place after printing of 10000 sheets. Further, when a soft resin was used in Comparative Example 3, it was confirmed that no filming took place, but the wear amount of film was increased.

As described above, it was confirmed that according to the present invention, the wear amount of a photoreceptor surface can be reduced upon long-term use, and moreover, the occurrence of filming was not observed on the photoreceptor surface and a stable image can be obtained.

DESCRIPTION OF SYMBOLS

1 Electroconductive substrate; 2 Undercoat layer; 3 Monolayer type photosensitive layer; 4 Charge generation layer; 5 Charge transport layer; 6,7 Laminate type photosensitive layer; 8 Photoreceptor; 21 Charging member; 22 High voltage power supply; 23 Image exposure member; 24 Developing device; 241 Developing roller; 25 Paper feed member; 251 Paper feed roller; 252 Paper feed guide; 26 Transfer charger (direct charging type); 27 Cleaning device; 271 Cleaning blade; 28 Discharge member; 60 Electrophotographic apparatus; and 300 Photosensitive layer.

What is claimed is:

1. An electrophotographic photoreceptor, comprising:

an electroconductive substrate; and a photosensitive layer that is formed on the electroconductive substrate and that contains an inorganic oxide and a lubricant resin, wherein the lubricant resin contains a polycarbonate resin having a siloxane structure therein or a polyarylate resin having a siloxane structure therein, and wherein, when light having a wavelength of 780 nm is irradiated onto a slurry containing 20% by mass of the inorganic oxide in a predetermined solvent to provide an inorganic oxide slurry, the inorganic oxide slurry has a light transmittance that is 80% or more.

2. The electrophotographic photoreceptor according to claim 1, wherein the photosensitive layer is a negatively-charged laminate-type photosensitive layer composed of a charge generation layer and a charge transport layer formed sequentially on the electroconductive substrate, wherein the charge transport layer contains the inorganic oxide and the lubricant resin.

3. The electrophotographic photoreceptor according to claim 1, wherein the photosensitive layer is a monolayer-type photosensitive layer.

4. The electrophotographic photoreceptor according to claim 1, wherein the photosensitive layer is a positively-charged laminate-type photosensitive layer composed of a charge transport layer and a charge generation layer formed sequentially on the electroconductive substrate, and wherein the charge generation layer contains the inorganic oxide and the lubricant resin.

5. The electrophotographic photoreceptor according to claim 1, wherein the inorganic oxide slurry has a viscosity of 50 mPa·s or less.

6. The electrophotographic photoreceptor according to claim 1, wherein the inorganic oxide has a primary particle diameter that ranges from 1 to 500 nm.

7. The electrophotographic photoreceptor according to claim 1, wherein the photosensitive layer is an outermost layer.

8. The electrophotographic photoreceptor according to claim 1, wherein the inorganic oxide comprises silica as a main component.

9. The electrophotographic photoreceptor according to claim 8, wherein the inorganic oxide further comprises from 1 ppm or more to 1000 ppm or less of aluminum.

10. The electrophotographic photoreceptor according to claim 8, wherein the inorganic oxide is surface-treated with a silane coupling agent.

11. The electrophotographic photoreceptor according to claim 10, wherein the silane coupling agent has a structure represented by general formula (1) below:

$$(R_1)_n—Si—(OR_2)_{4-n} \quad (1),$$

where Si represents a silicon atom, $R_1$ represents an organic group in a form where carbon is directly bonded to the silicon atom, $R_2$ represents an organic group, and n represents an integer of 0 to 3.

12. A method for producing the electrophotographic photoreceptor according to claim 1, comprising:

preparing a coating solution for the photosensitive layer by:

dispersing the inorganic oxide in a first solvent to provide a dispersion;

dissolving the lubricant resin and another resin in a second solvent to provide a solution; and mixing the dispersion and the solution to provide the coating solution; and coating the coating solution onto the electroconductive substrate to provide the photosensitive layer, wherein the inorganic oxide comprises silica as a main component and from 1 ppm or more to 1000 ppm or less of aluminum, wherein A parts by mass of the lubricant resin and B parts by mass of the another resin are used as a resin binder and a ratio of the lubricant resin to a total amount of the resin binder is given by A/(B+A) and satisfies $0.1 \leq A/(B+A) \leq 0.5$, and wherein, when light having a wavelength of 780 nm is irradiated onto a slurry containing 20% by mass of the inorganic oxide in the predetermined solvent, the inorganic oxide slurry has a light transmittance that is 80% or more.

13. An electrophotographic apparatus, comprising the electrophotographic photoreceptor according to claim 1 mounted therein.

* * * * *